United States Patent [19]

Barry

[11] 4,082,042

[45] Apr. 4, 1978

[54] OVERHEAD CONTAINER TRANSFER SYSTEM

[76] Inventor: Leonard D. Barry, 19300 Pennington Dr., Detroit, Mich. 48221

[21] Appl. No.: 710,214

[22] Filed: Jul. 30, 1976

Related U.S. Application Data

[63] Continuation of Ser. No. 405,825, Oct. 12, 1973, abandoned.

[51] Int. Cl.[2] ..... B61K 1/00

[52] U.S. Cl. ..... 104/18; 104/88; 104/122

[58] Field of Search ..... 104/32 R, 32 A, 88, 104/89, 18, 19, 20, 122, 33; 214/38 CB, 58

[56] References Cited

U.S. PATENT DOCUMENTS

| | | | |
|---|---|---|---|
| 3,910,196 | 10/1975 | Denenburg | 104/20 |
| 3,956,994 | 5/1976 | Barry | 104/18 |

*Primary Examiner*—Trygve M. Blix
*Assistant Examiner*—D. W. Keen

[57] ABSTRACT

This invention is a continuation of my system for vertical transfer of containers to and from moving vehicles wherein the improvement comprises the simplification of the double-dip overhead track for containers or container carriers by elimination of some or all of the dip switches and controls therefore, the track having transfer dips and rises spaced apart and at different gage or elevation with rails for front wheels on container or carrier out of phase with rails for the rear wheels in spaced relation so that containers or container carriers have wheels at one end to run on outer rails and wheel or wheels at other end to run on inner, narrower gage, or upper rails substantially maintaining the container or carrier level on the dips and rises of the overhead track. This invention includes wheel arrangements for container or container carrier for these tracks. This invention is shown applied in both passenger and freight transfer systems and for both split dip and rise spaced apart for containers or carriers with wheels which leave the dip and enter the rise (lift out before set in) and continuous or connected dip and rise (set in before lift out). Passenger cars have novel coupling carriage and track on roof to receive containers at considerable speed difference. The containers or container carriers on the station tracks are propelled and retarded by conveyors or by wave motion of sections of the track to eliminate need for being self propelled. A gantry of special and simplified design transfers containers to and from storage to put them in waiting order for the train. Containers are stored on carriers on classification tracks.

20 Claims, 92 Drawing Figures

AIR

DYN1
DYN2
DYN3
PM1
PM2
AIR
CD
ST
HI
SPEED OF CONTAINER
SPEED OF TRAIN
DISTANCE FEET
MPH
AC
CC
CS
CC&CS
STD
TS
40DC
30DC
20DC
10DC

AIR 499R
499L
12PF
TR
TR'
TL
TL'
DD
RH1
RH2
502R
502L
330
458
500
504
422
424
420
426
428
430
432
425
427
344
47
444
448
450
452
454
362
468
470
472
473
474
476
478
480
482
484
486
487
488
490
492
493
494
496
497
498
461R
461L
462R
462L
464
466

OVERHEAD CONTAINER TRANSFER SYSTEM

This is a continuation, of application Ser. No. 405,825 filed Oct. 12, 1976 now abandoned.

An object of this invention is to simplify and reduce the cost of the system disclosed in my U.S. Pat. Nos. 3,483,829 and 3,484,002 and 3,956,994. It is an object to provide a switchless or nearly switchless douple-dip transfer run or station to provide level transfer as on my earlier double dip but eliminate need for entry switches and the dip bypass. Another object is to provide an at-speed container transfer system for existing subways, without enlargement, and which takes the container or container carrier into the car to eliminate station track between stations. Some other and further objects are to retard and propel carriers or containers on overhead track by resting the containers on belt conveyors or by cable tows or by causing waves in the station track rails, to provide low cost means for accelerating container to safe coupling with train in least practical distance, to provide on car container catapult for aligning container with empty berth, to eliminate propulsion means on carrier or container, to provide a lower cost safe high capacity container transfer system, to provide inexpensive carriers for storing one container each to eliminate need to unload and reload carriers between trains, to eliminate signaling reservations between train cars and carriers for loading, to provide classification tracks and transfer gantries for carriers to be loaded and grouped ahead of train so freight trains can follow in close succession by station for container transfer, to provide self controlled hooks to engage container on car or release container lowered to car at same elevation so same vertical movement can serve to load or unload to eliminate hook signaling controls.

These and other objects, features and advantages should become apparent to those skilled in the art upon consideration of this invention as disclosed with reference to the drawings wherein.

Figures 1, 2, 3, 4, 5, 6, 7:
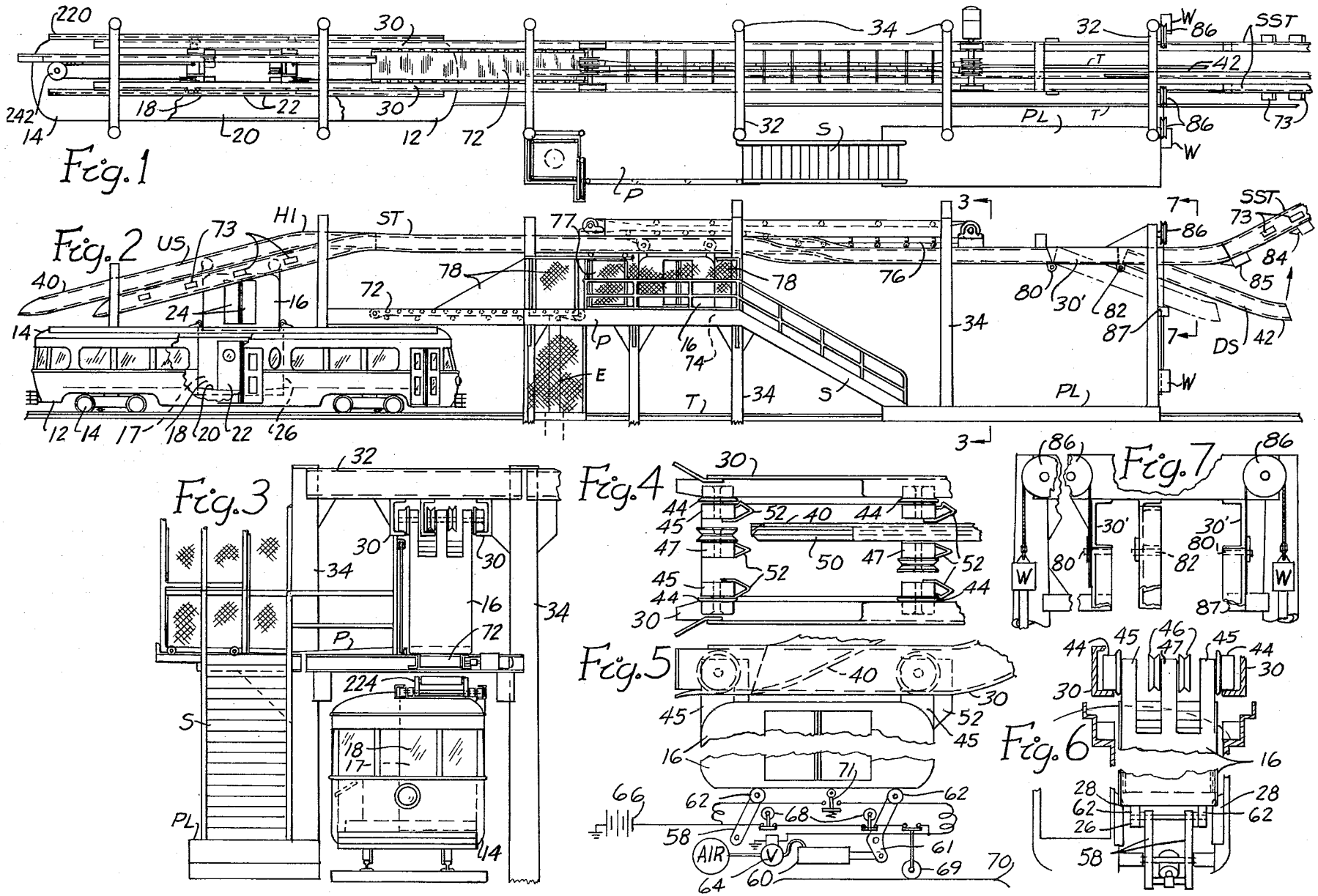
FIGS. 1 and 2 are respectively plan and side views of a self-propelled passenger railway car transferring a container out and up on station track for deceleration to station platform wherefrom a container is being accelerated to insert into the car at speed.
FIG. 3 is an enlarged section across railway at 3—3 of FIG. 2.

FIGS. 4, 5, and 6 are plan side and end views of container lifted on car and engaging lift out rails at beginning of station track.

FIG. 7 is a section taken on line 7—7 of FIG. 2.

Figures 8, 9, 10, 11, 12, 13, 14, 15:
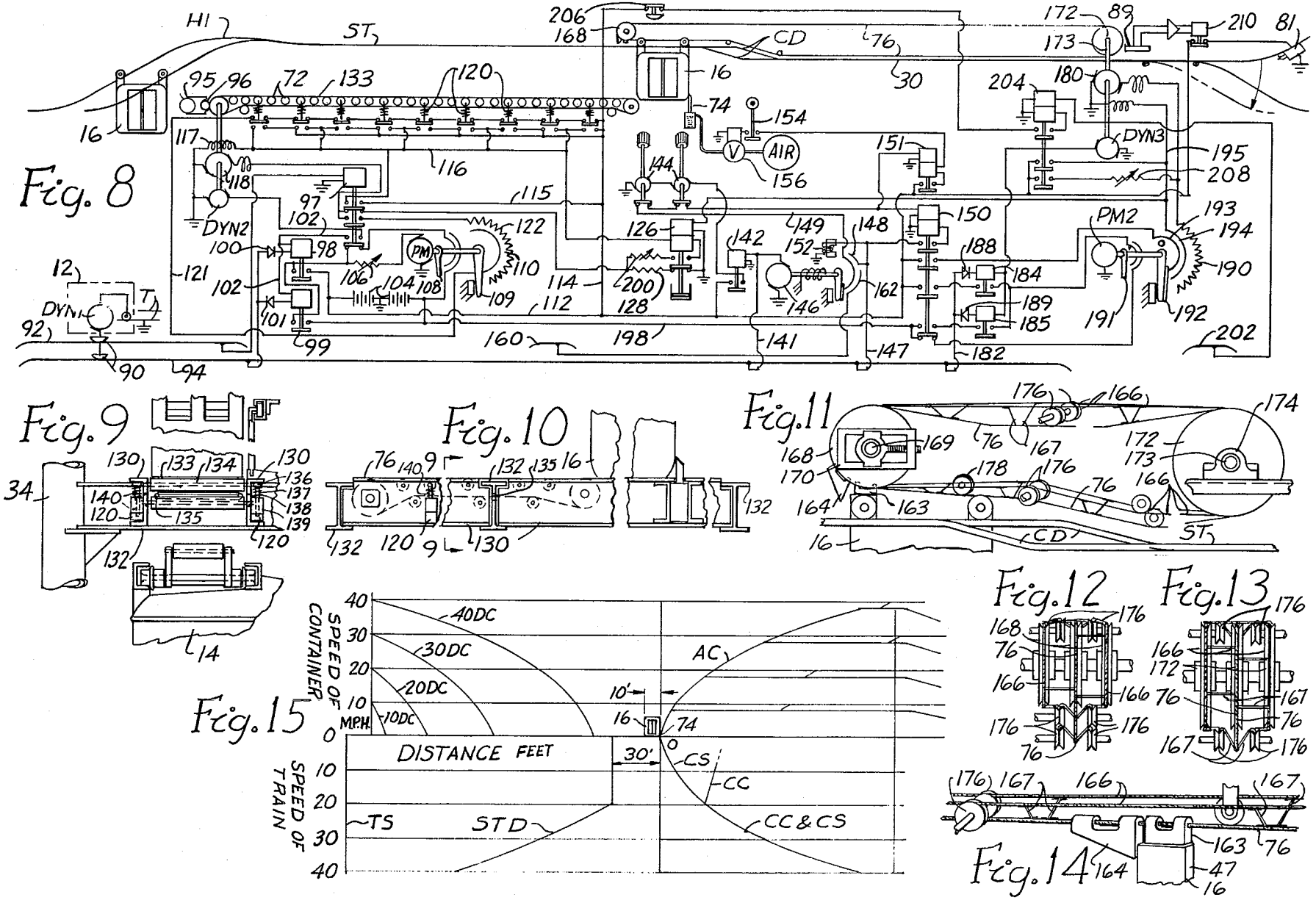

FIG. 8 is a schematic of station conveyor and cable tow and controls with station stop, tracks and containers shown.

FIG. 9 is a cross section on line 9—9 of FIG. 10.

FIG. 10 is a side view of decelerating conveyor and stop at station with container thereat.

FIG. 11 is side view of cable tow accelerator engaging top of container at station stop.

FIGS. 12 and 13 are respectively front and rear elevations of the accelerator.

FIG. 14 is oblique side view of accelerator cables with dog and snubber engaging container.

FIG. 15 is a graph of Distance along station track vs. Speed of incoming and outgoing containers for various train speeds.

Figures 16, 17, 18, 19, 20, 21, 22, 23, 24:
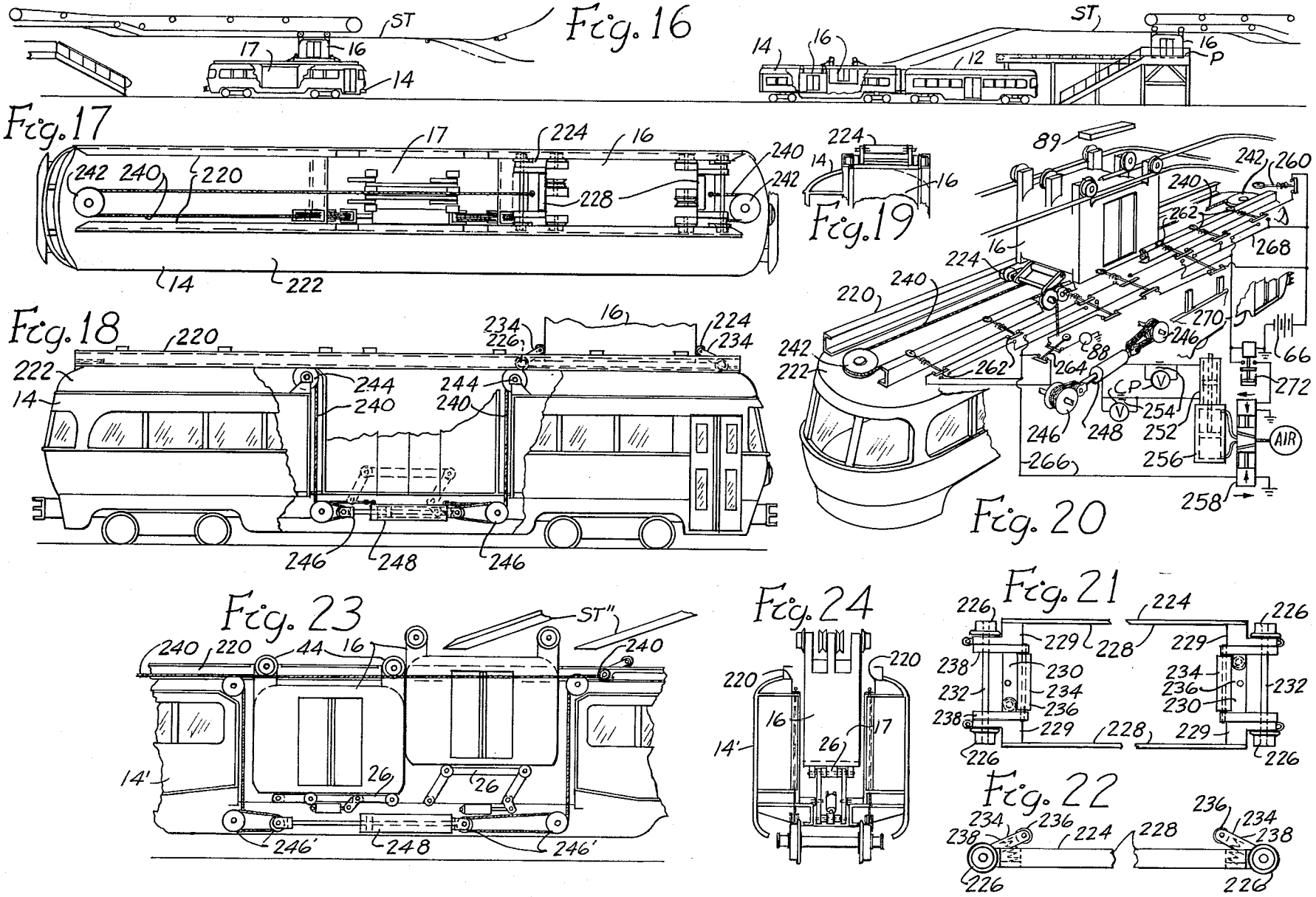

FIG. 16 is a side elevation of the railway between stations with trains and containers shown.

FIGS. 17 and 18 are top and side views of a self-propelled passenger container transfer car engaging a container for transfer thereinto, with portion of side of car removed to show container berth and transfer controls.

FIG. 19 is a transverse section through the top of the car at front.

FIG. 20 is a perspective of the car with roof mounted coupling carriage receiving container from station and schematic of controls for accelerating and aligning the carriage for transfer of the container into the car.

FIGS. 21 and 22 are plan and side views of the container coupling carriage for mounting on channel track on top of either passenger transfer container car.

FIGS. 23 and 24 are side and cross sectional elevations of central portion of a railway car for carrying two containers on center.

Figures 25, 26, 27, 28, 29, 30, 31:
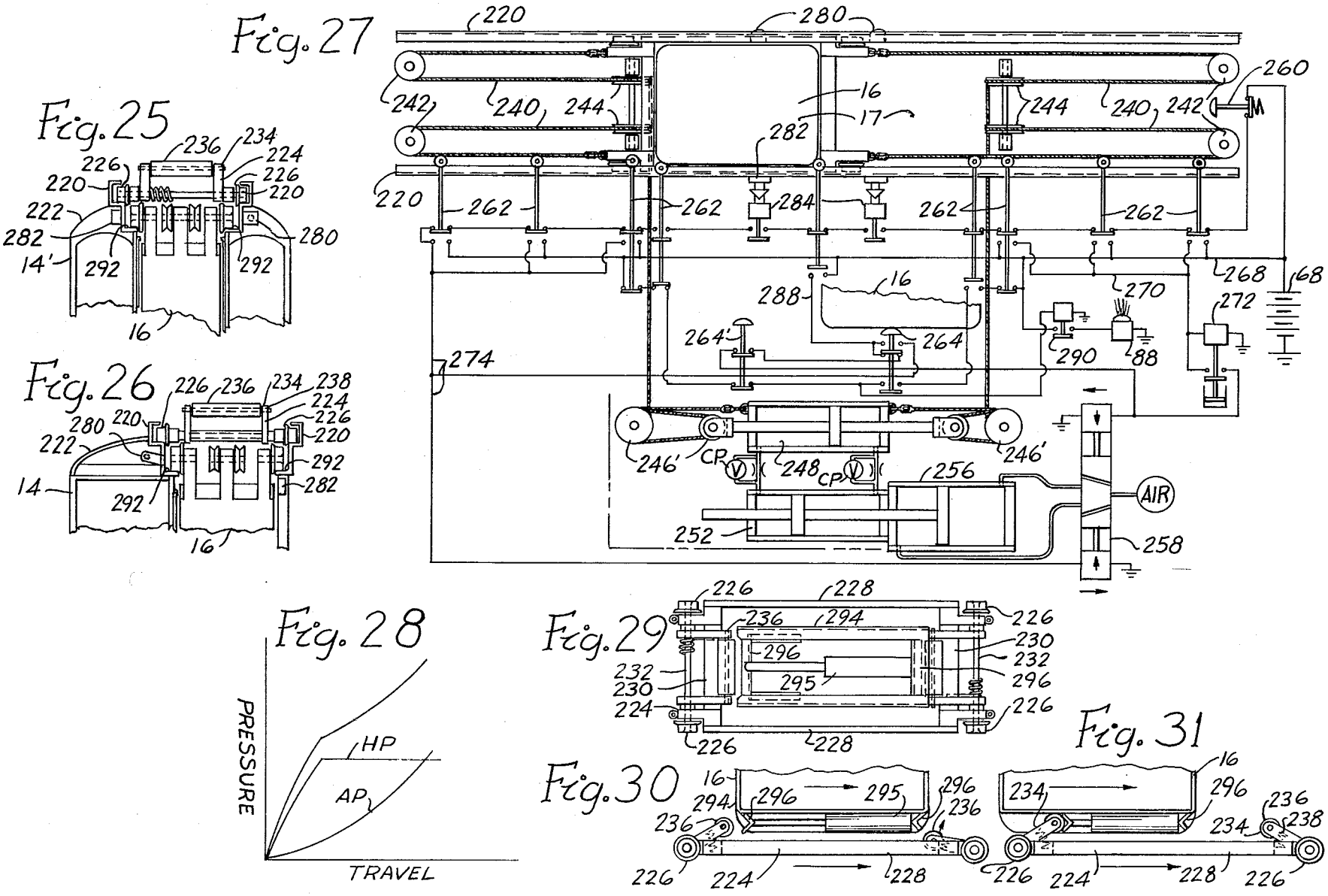

FIGS. 25 and 26 are transverse sectional views of top portion of railway cars of FIGS. 24 and 19 respectively and to larger scale showing container down in the berth.

FIG. 27 is a schematic of the coupling carriage controls for the two berth container car of FIG. 23.

FIG. 28 is a graph of Pressure or force on carriage vs. Distance of carriage movement back from front of car accelerating container.

FIGS. 29, 30 and 31 are respectively a plan and two side views of the coupling carriage engaging a shock absorbing bumper on bottom of container before and after absorbing some of the impact.

Figure 32:
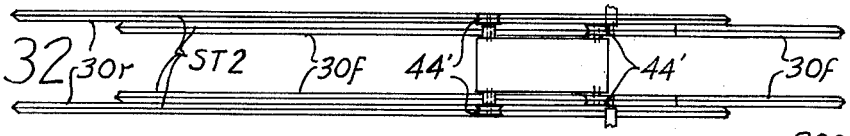
Figure 33:
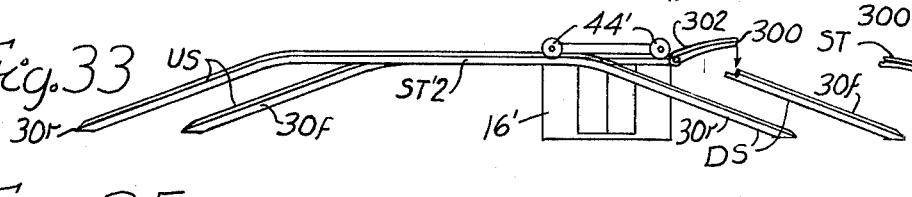

FIGS. 32 and 33 are schematic plan and side elevations of a variation of the station track with container approaching dip to the car (not shown).

Figure 34:
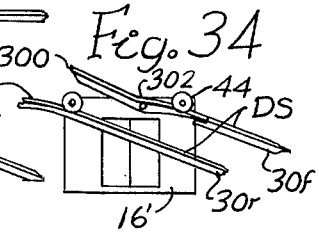

FIG. 34 is side view of the container passing switch of FIG. 33.

Figure 35:
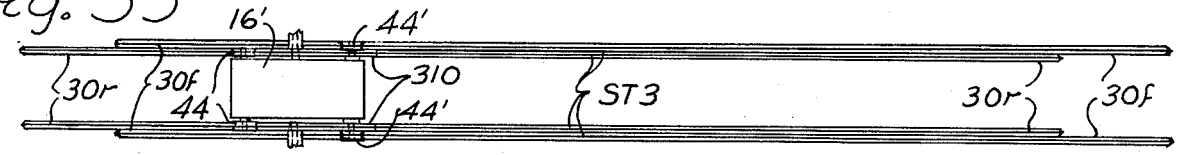
Figure 36:
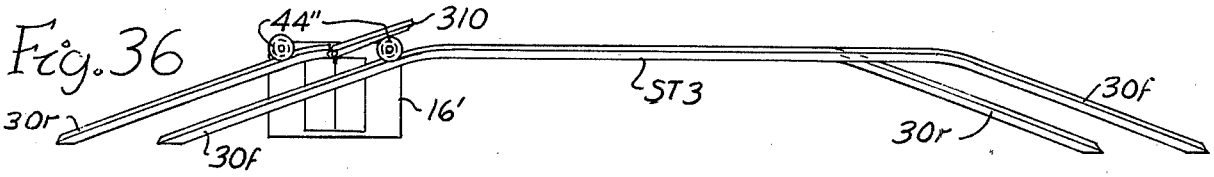

FIGS. 35 and 36 are plan and side elevations of another variation of the station track with container.

Figure 37:
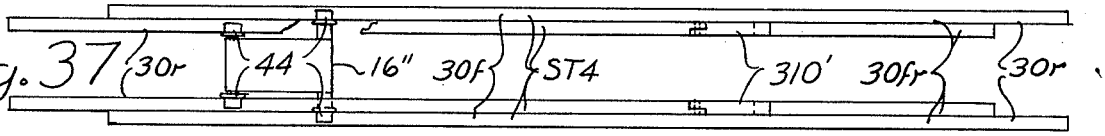
Figure 38:
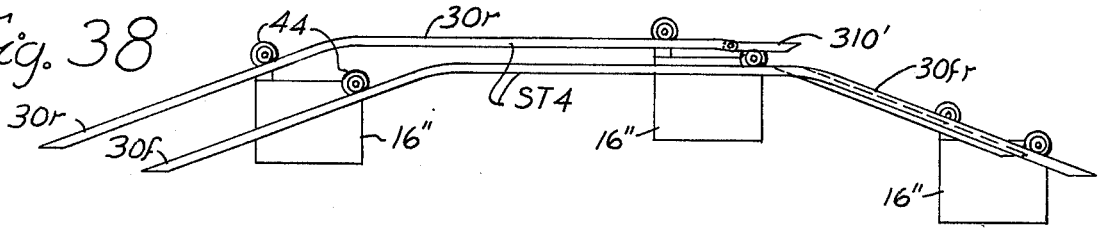

FIGS. 37 and 38 are plan and side elevations of another variation of the station track with containers.

Figure 39:
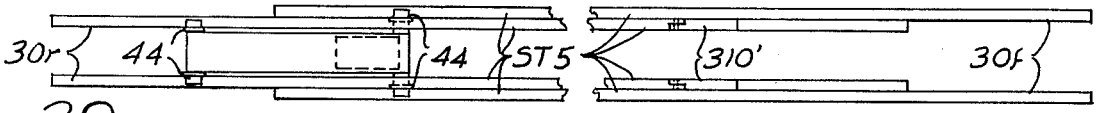
Figure 40:
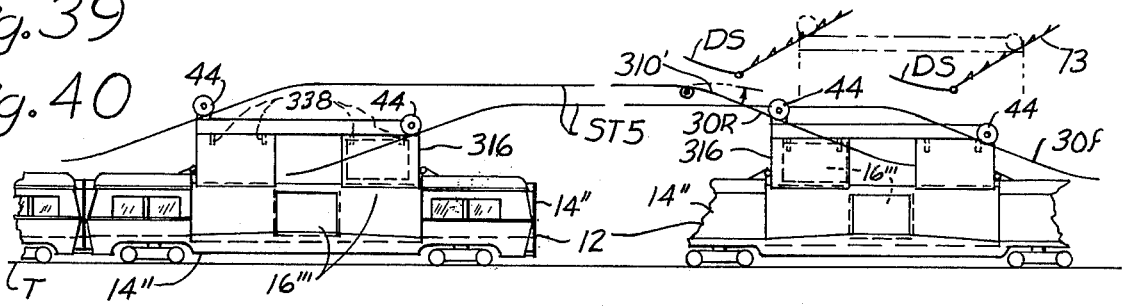

FIGS. 39 and 40 are plan and side elevation of another variation of the station track for long container carriers which recess into railway cars shown leaving car at left and entering car at right to stay in car.

Figure 41:
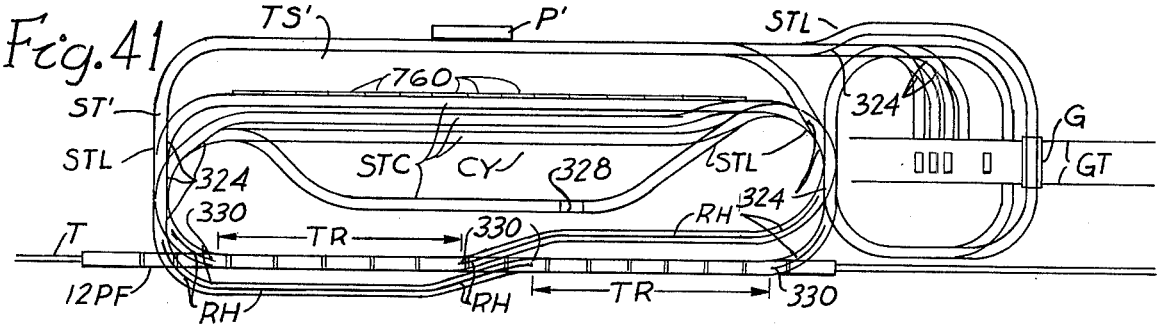

FIG. 41 is a plan view of container storage and transfer station.

Figure 42:
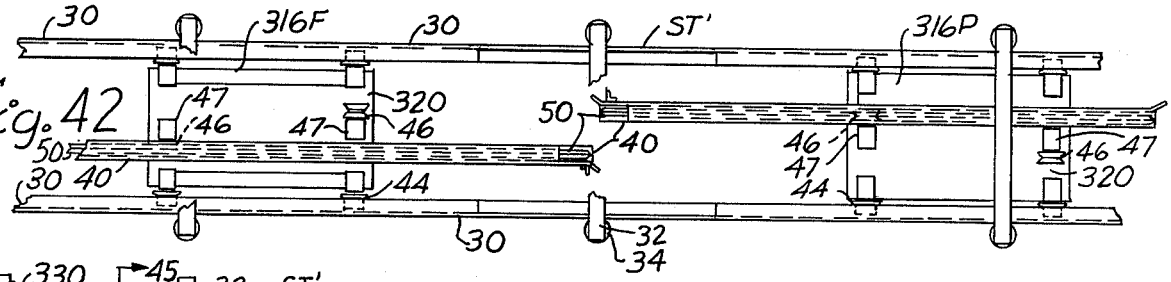
Figure 43:
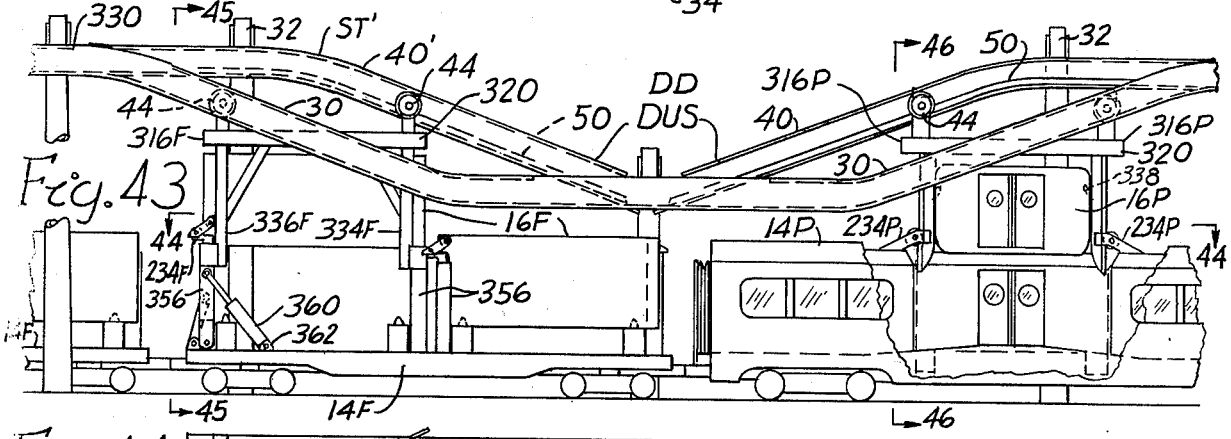

FIGS. 42 and 43 are plan and side views of a three-rail double-dip station track with carriers transferring cargo and passenger containers to or from moving train.

Figure 44:
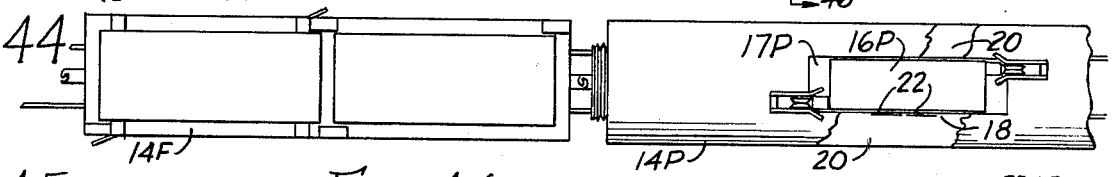

FIG. 44 is a section on lines 44—44 of FIG. 43 to show car plans.

Figure 45:
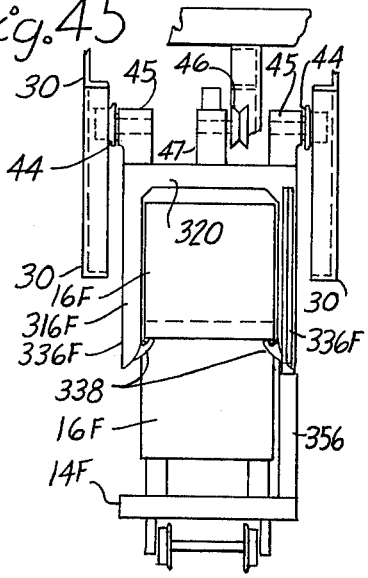
Figure 46:
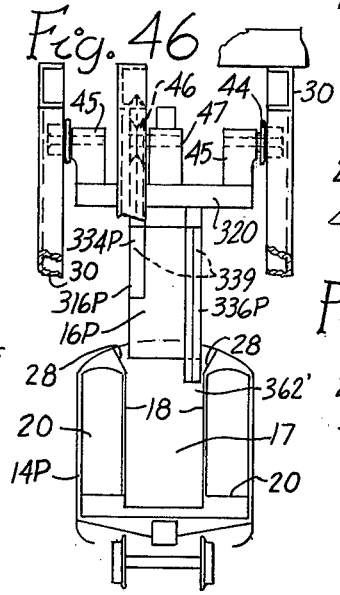

FIGS. 45 and 46 are respectively cross sectional elevations taken on line 45—45 and 46—46 of FIG. 43.

Figure 47:
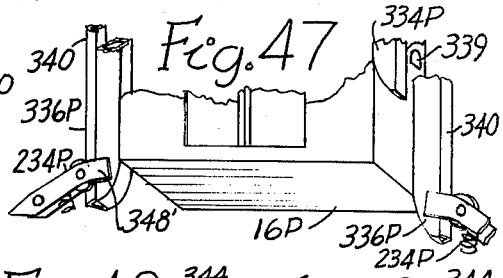

FIG. 47 is a partial perspective view looking up at passenger container on carrier to show staggered coupling columns depending from the carrier.

Figure 48:
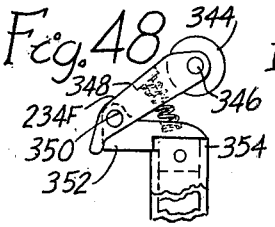
Figure 49:
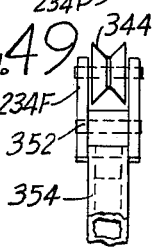

FIGS. 48 and 49 are side and end views of vertical coupling latch on a container freight car of FIGS. 43–44.

Figure 50:
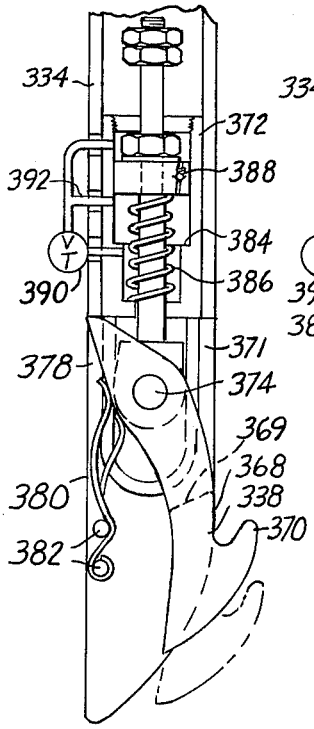
Figure 51:
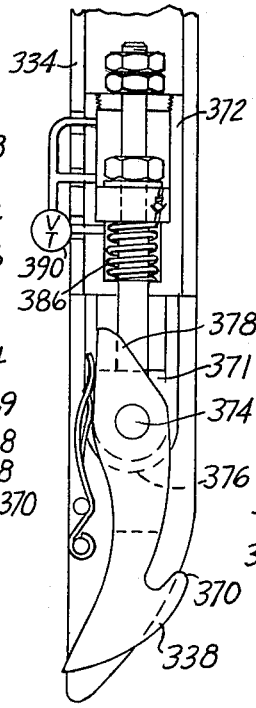

FIGS. 50 and 51 are transverse sections of a hook column showing hook in latching and open positions respectively.

Figure 52:
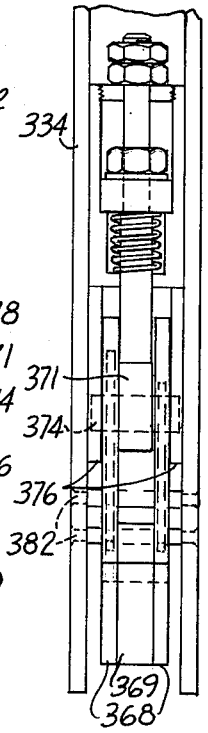

FIG. 52 is hook-face view of FIG. 51.

Figure 53:
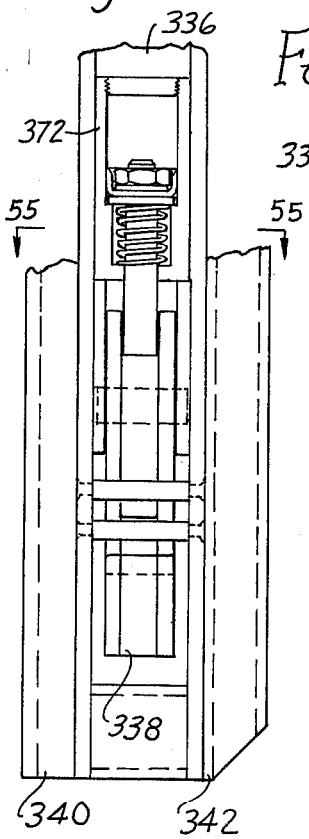

FIG. 53 is face view of a hook column with lower coupling extension and reinforcements.

Figure 54:
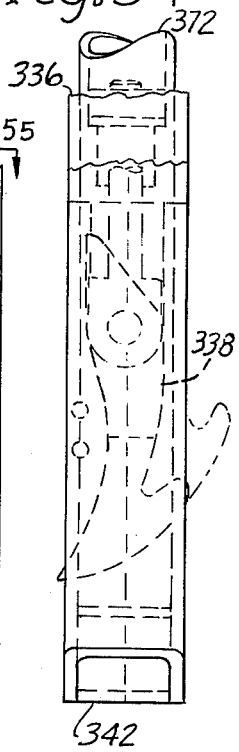

FIG. 54 is a transverse elevation of the hook column of FIG. 53.

Figure 55:
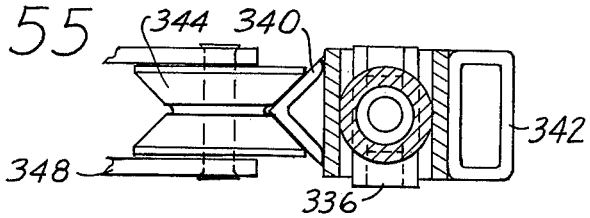

FIG. 55 is a sectional plan of hook column of FIGS. 53–54 engaged by coupling latch.

Figure 56:
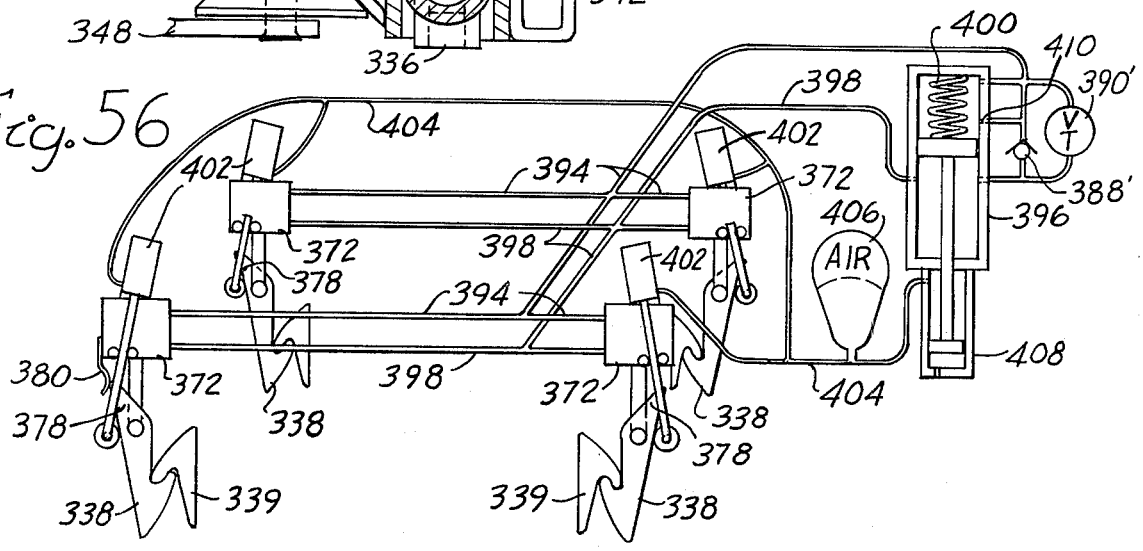

FIG. 56 is a prespective schematic of controls for coordinating operation of the container hooks shown engaging a load.

Figures 57, 58, 59, 60:
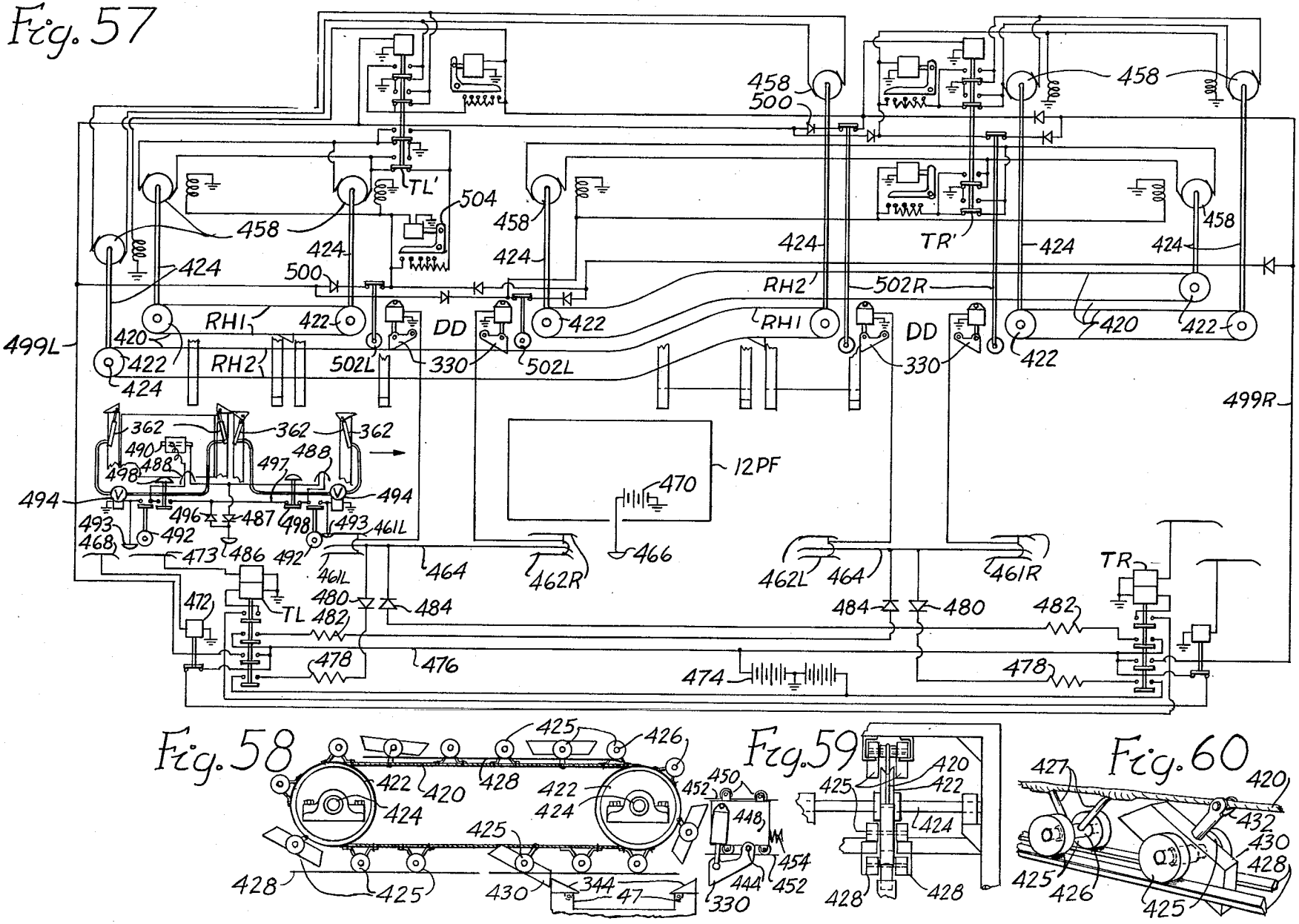

FIG. 57 is schematic of ropehauls for carriers at station of FIG. 41.

FIGS. 58 and 59 are respectively partial side and end elevations of a ropehaul of FIG. 57.

FIG. 60 is a perspective along portion of a ropehaul of FIG. 57.

Figure 61:
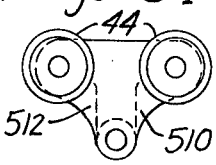

FIG. 61 is a side view of a truck for the carrier.

Figure 62:
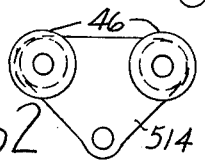
Figure 63:
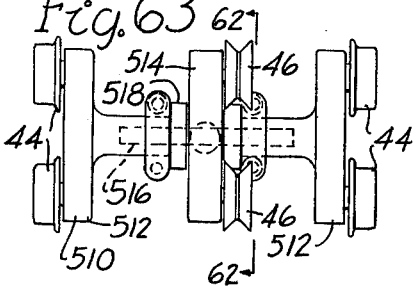

FIG. 62 is a sectional view on line 62—62 of FIG. 63.

FIG. 63 is a plan view of the carrier truck.

Figure 64:
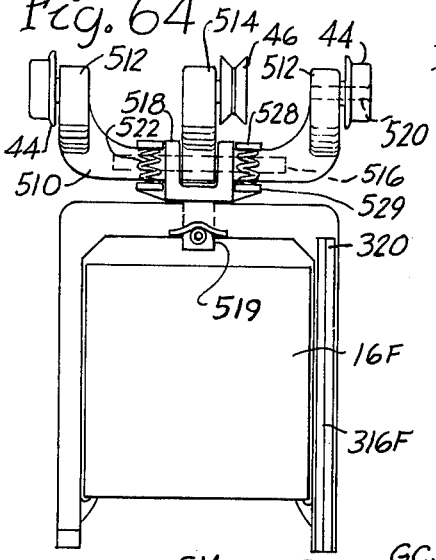

FIG. 64 is an end view of a freight carrier supported on two trucks of FIGS. 61-63 and supporting a container thereon.

Figure 65:
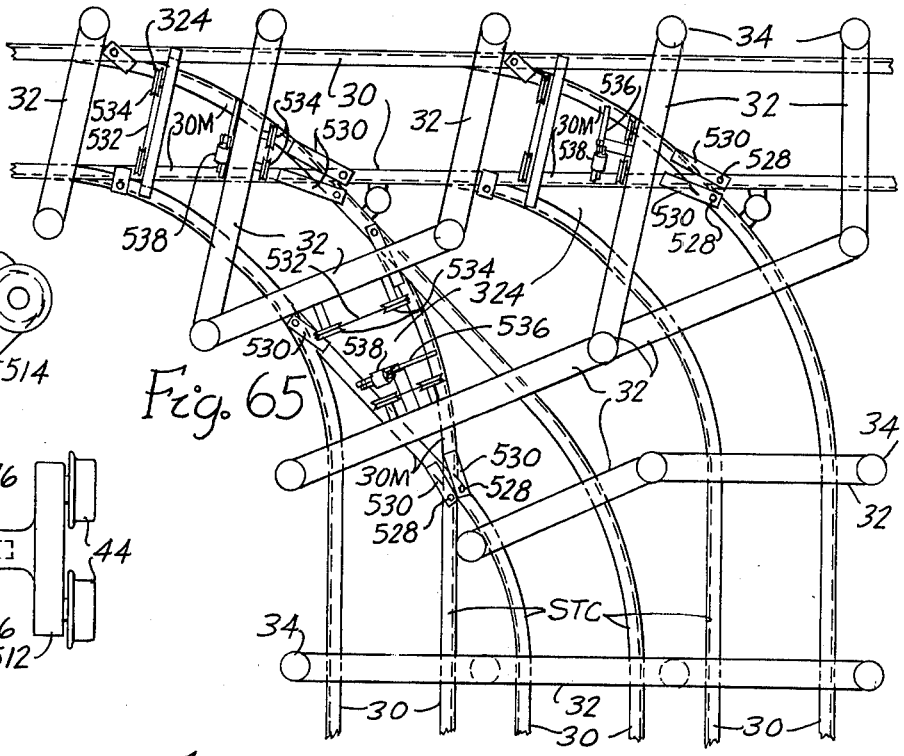
Figure 66:
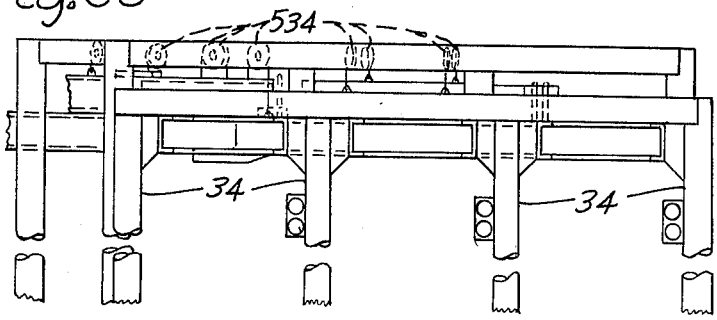

FIGS. 65 and 66 are plan and end elevations of the station at ladder track at left end of station, FIG. 41, to larger scale.

Figure 67:
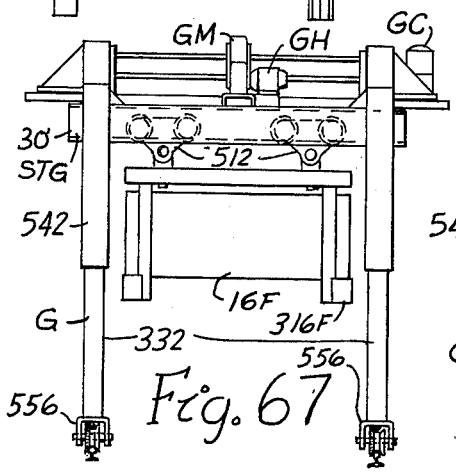
Figure 68:
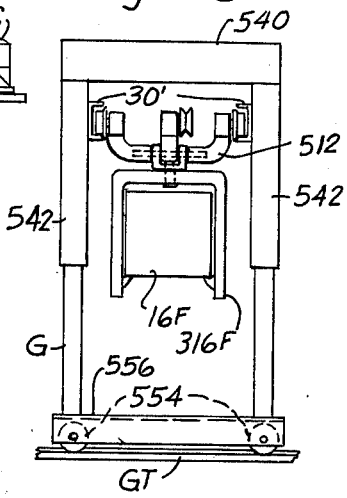

FIGS. 67 and 68 are respectively end and side views of gantry for transfer of container on carrier between storage spots and the station track.

Figure 69:
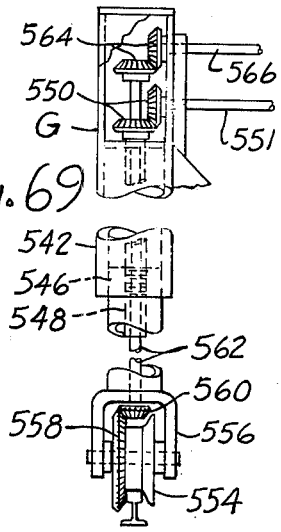

FIG. 69 is an end elevation of a leg of the gantry to larger scale.

Figure 70:
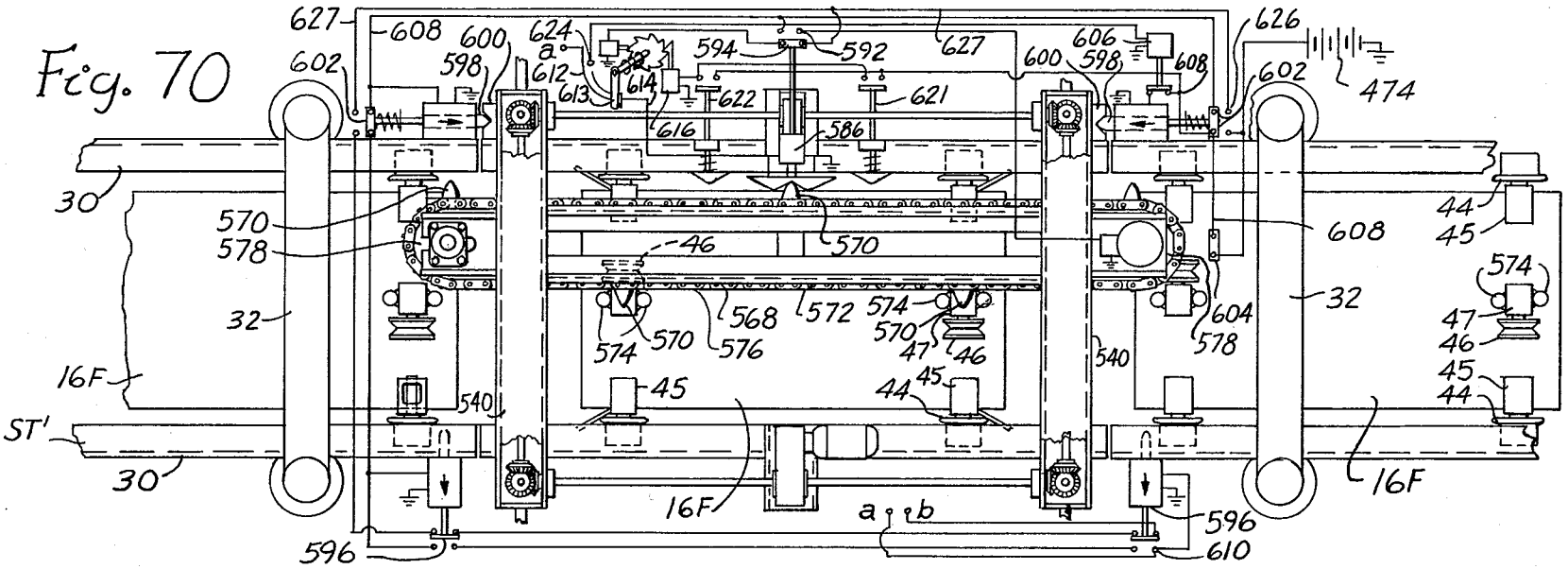
Figure 71:
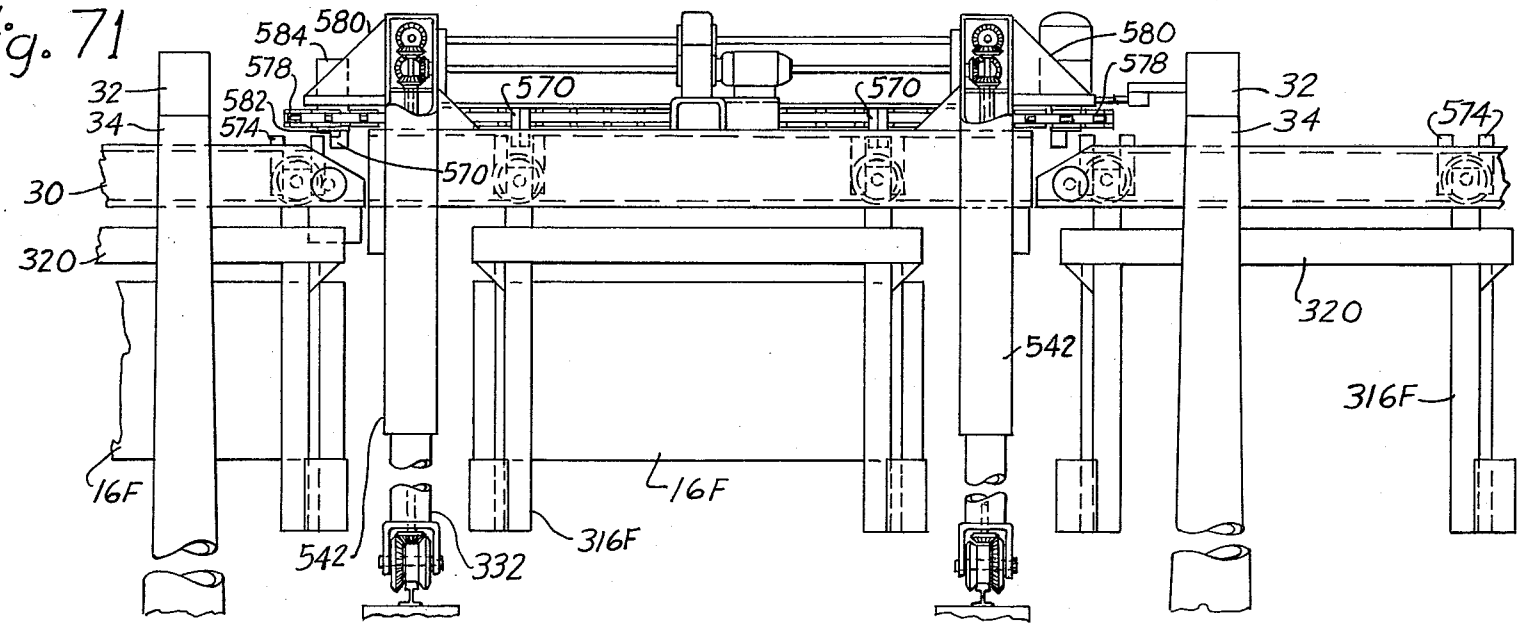

FIGS. 70 and 71 are respectively plan and side elevation of the gantry with carrier with container and schematic of alignment controls.

Figure 72:
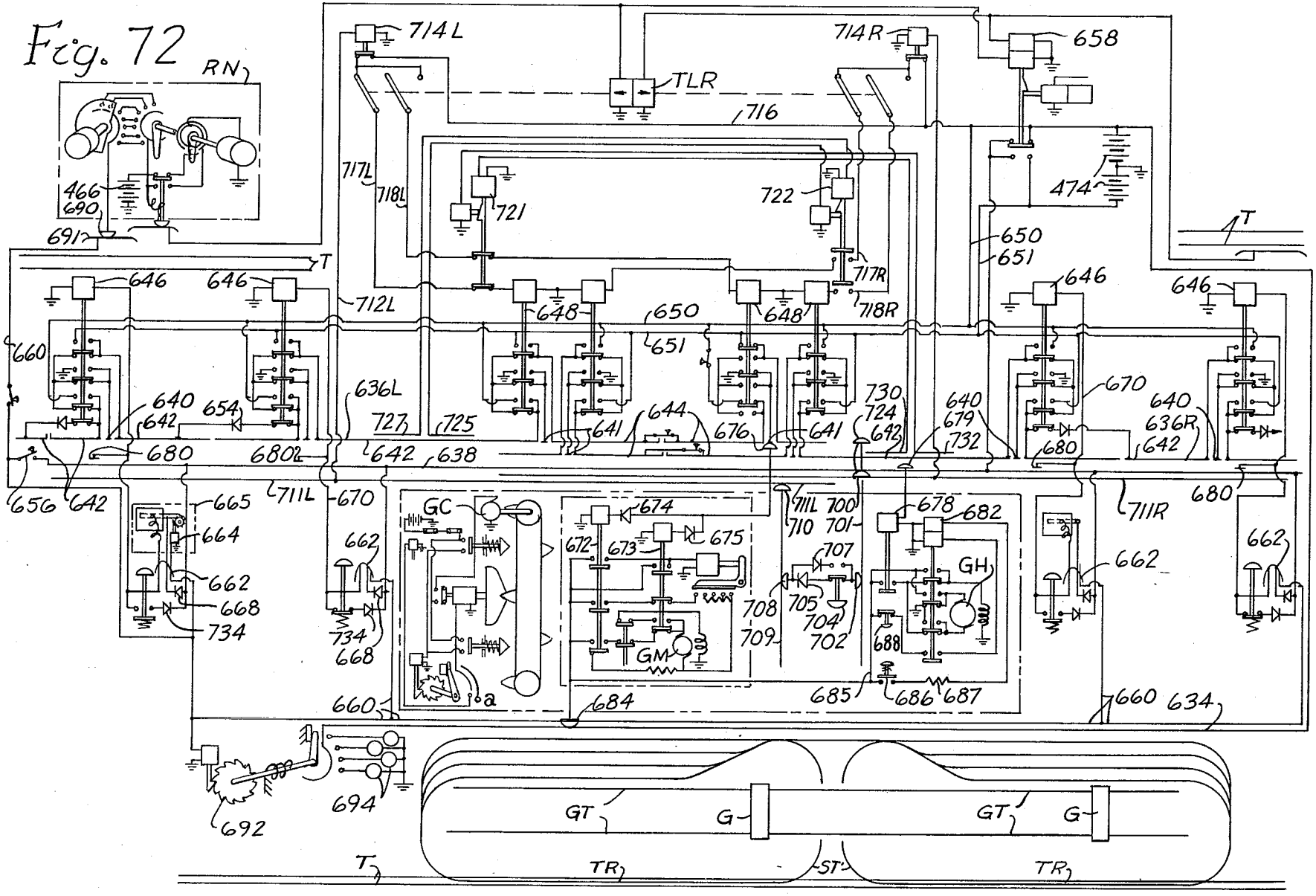

FIG. 72 is schematic of gantry controls.

Figures 73, 74, 75, 76, 77, 78, 79, 80:
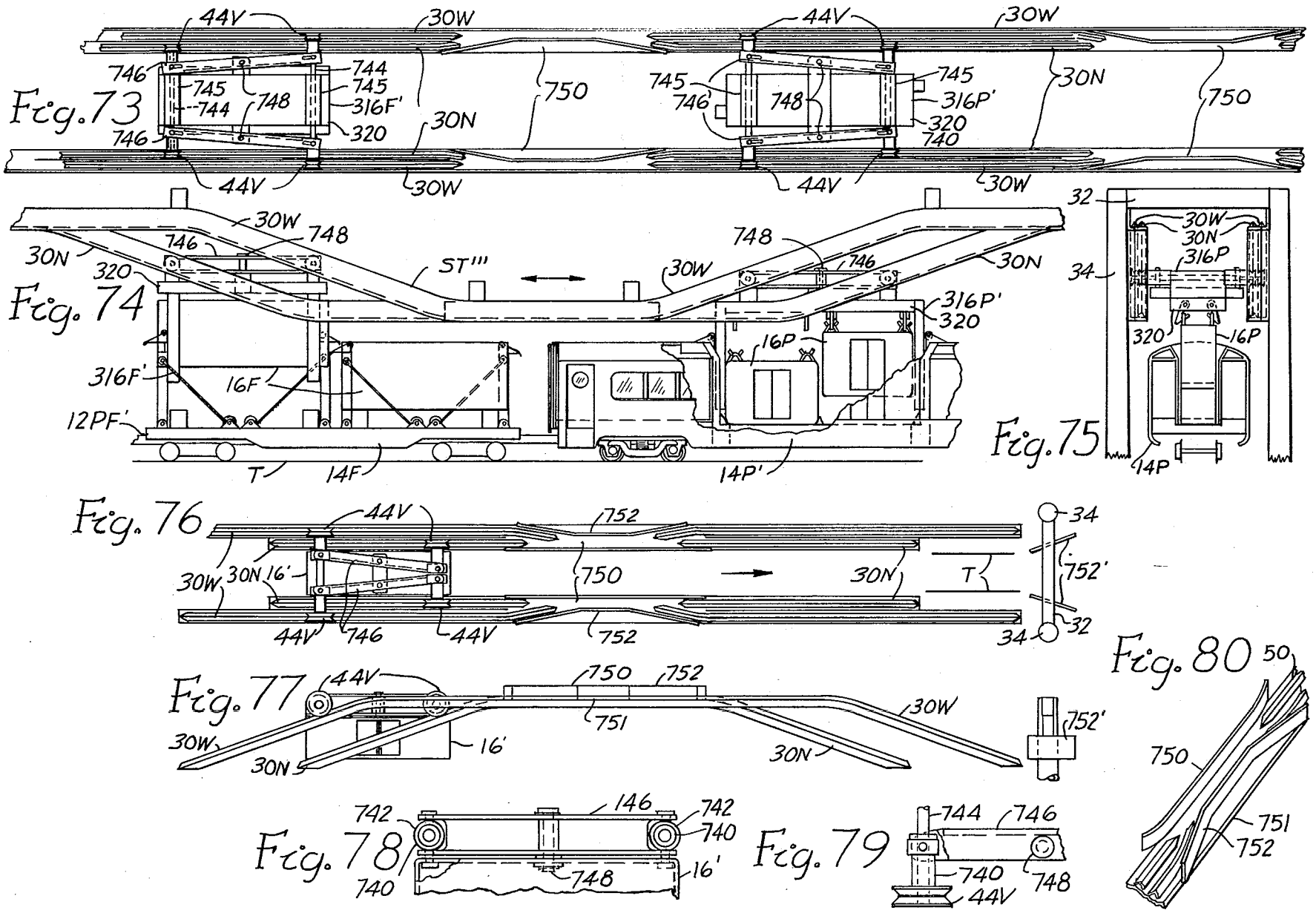

FIGS. 73-75 are plan, side, and end sectional views of gage changing dip track with carriers loading and unloading train.

FIGS. 76 and 77 are plan and side elevation of lift-out gage-shift and set-in track with carriers thereon.

FIGS. 78 and 79 are side and partial plan of gage-shift on a carrier.

FIG. 80 is perspective of gage-shift switch of FIGS. 73-77.

Figure 81:
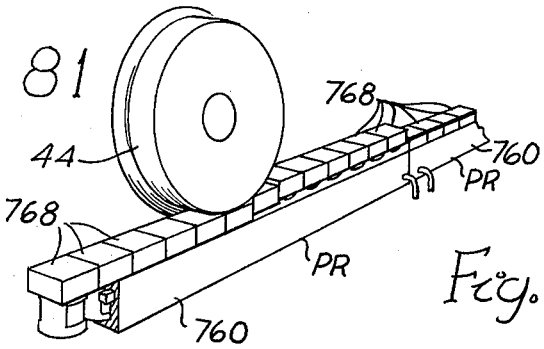

FIG. 81 is a perspective of wheel on accelerating-decelerating rail.

Figure 82:
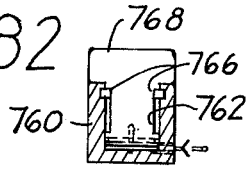
Figure 83:
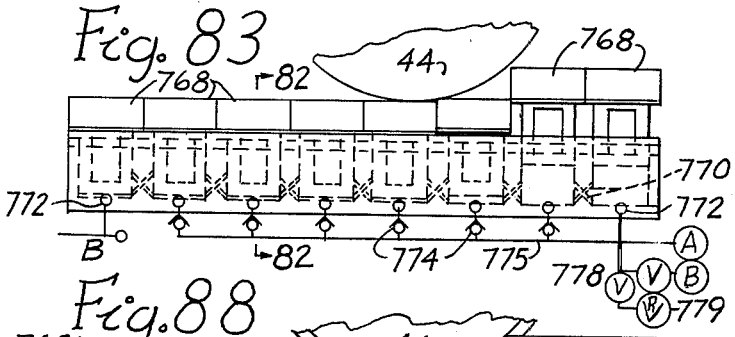

FIGS. 82 and 83 are respectively sectional and side views of the propulsive rail of FIG. 81, the section being taken on line 82—82 of FIG. 83.

Figure 84:
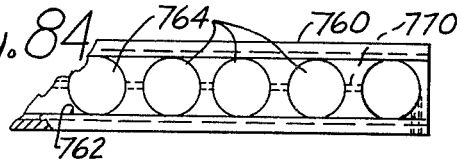

FIG. 84 is a plan of portion of base for rail FIGS. 81-83.

Figure 85:
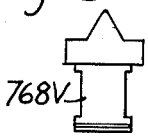
Figure 86:
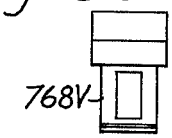

FIGS. 85 and 86 are respectively sectional and side views of a V-rail head for replacing the flat rail heads of FIGS. 81-83.

Figure 87:
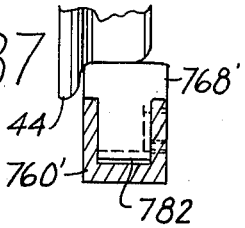
Figure 88:
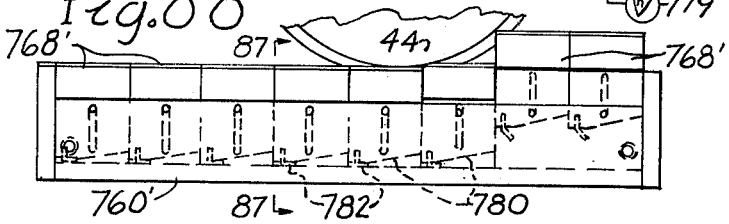

FIGS. 87 and 88 are respectively sectional and side views of a variation of the propulsion rail, the section being taken on lines 87—87 of FIG. 88.

Figure 89:
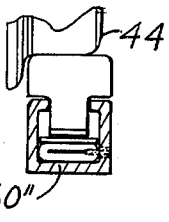
Figure 90:
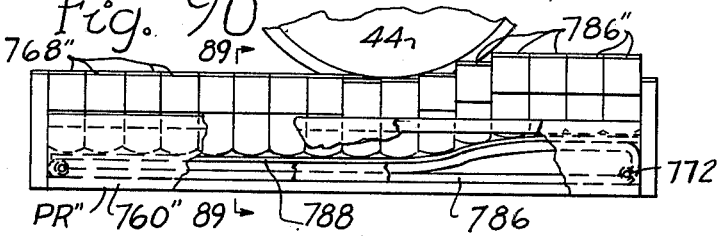

FIGS. 89 and 90 are respectively sectional and side views of another variation of propulsion rail, the section being on line 89—89 of FIG. 90.

Figure 91:
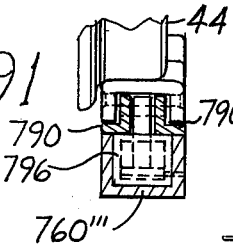
Figure 92:
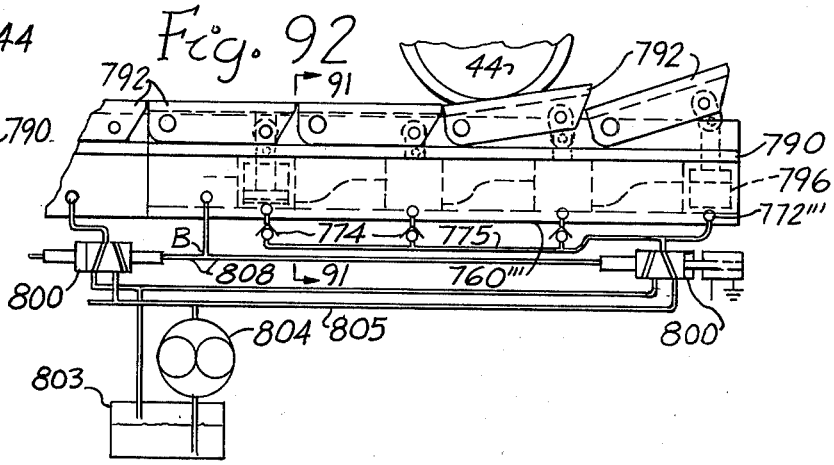

FIGS. 91 and 92 are respectively sectional and side views of another variation of propulsion rail, the section being on line 91—91 of FIG. 92, the controls for all the propulsion rails being shown in FIG. 92.

Referring to the drawings and in particular to FIGS. 1 and 2, where a train 12 comprising a self-propelled railway passenger car 14 is shown traveling from left to right nonstop under station track ST which runs along above track T for a distance by and beyond each end of an elevated station platform P to transfer passenger containers 16 to and from the train. Platform P is reached by stairs S and hydraulic elevator E from a low platform PL or ground level.

Car 14 is shown pushing a container 16 out up incline rails of track ST which lift the container out of car 14 as it moves forward. Car 14 has a berth area 17 below and for the container. Partition 18 separates berth 17 from aisle 20 past the berth to seating in ends of the car. Partition 18 has doors 22 which align doors 24 in the enclosed container 16. The berth has a container lift platform 26 and tapered tabs or locators 28 either on the platform or around about to engage bottom or sides of the container to position accurately on car 14. Platform 26 is lifted ahead of track ST to engage a container thereon with station track ST to lift out the container when transfer is desired and is lowered after receiving a container from the station at far end of track ST.

Track ST has two outer channel rails 30, FIGS. 1-6, turned legs in on wide gage and supported from beams 32 connecting columns 34 arranged in transversely aligned pairs straddling track T. From left, track ST runs up a lifting slope US, then along a decelerating run to station platform P, on through accelerating and coupling runs to lowering slope DS. Track ST also has an auxiliary lifting rail 40 and a lowering rail 42 respectively just ahead of channels 30 on the lifting slope US and just after channels 30 on the lowering slope DS each equally and oppositely offset from center of track between channels 30. The rectangular container 16 has four flanged wheels 44 each mounted outboard with flange in on a projection 45 up from each top corner of the container and gaged to run on channel rails 30 of track ST. Container 16 has two V-grooved wheels 46 mounted one above each end of the container each on oppositely facing sides of a central vertical projection 47 from the container so wheels 46 are transversely offset equally on opposite sides of center of track ST to engage and run on channel rail 40 or 42 respectively for the rear wheel 46 and the front wheel 46 according to which way the container is turned as it runs on track ST. Channel rail 40 runs up the push-out incline US the wheel base distance to rear from rails 30 to carry the rear of the container level as wheels 44 at front engaged between channels 30 run up the incline US. Rail 42 runs down the lowering incline DS to support the front of the container level as wheels 44 at the rear run down the incline DS of channels 30. Wheels 44 run on lower legs of channels 30. The top leg of each of these channels is cut away to top of lifting incline so rear wheels 44 can enter between channels 30 of track ST, and the top legs are cut away at head of down slope so forward wheels 44 can exit from channels 30 as the front of the container is carried on the wheel 46 at front. Track ST can be substantially symetrical from either end to work for container from either direction but is preferably non-symetrical as will be described. Channel rail 42 preferably runs from the station platform P along the station track and down a coupling dip CD a wheel base behind this coupling dip in rails 30 and on to and down the transfer dip DS to support the front of the container level with the rear on these dips and to eliminate need to engage the forward wheel 46 of the container with rail 42 after reaching coupling speed when leaving the station. Top legs of channels 30 are also cut away for front wheels 44 to leave at top of dip CD and to reenter between channels 30 at bottom of dip CD. Channel rails 40 and 42 each have an angle 50 turned legs down and secured along top of bottom leg on which V-grooved wheels 46 track to hold the container from twisting on track ST and dropping.

The container 16 is engaged onto track ST preferably as shown in FIGS. 4-6. For this engagement container 16 has V-guide angles 52 on front of each projection 45 and 47. Tapered guide plates 54 that flair out are added to entrance end of channels 30 to insure alignment. Rails 30 extend back substantially level to engage all four wheels 44 to align the container before V-groved wheel 46 at rear engages V-angle 50 on rail 42 so the container will be aligned accurately for this engagement. Entrance ends of rails 52 are turned down to channel 42, and bottom legs of channels 30 and 42 are turned down slightly on entering ends.

The container 16 in car 14 is lifted on platform or bed 26, FIGS. 5–6, in berth 17 to upper limit of travel of bed 26 to engage wheels 44 of the container onto track ST for the lift up incline US only when container and partition doors are closed safe for transfer. Bed 26 is supported on parallel arms 58 which are pivotally secured at top to bed 26 and at bottom to frame of car to form a parallelogram operated by air cylinder 60 pivotally connected between frame of car 12 and an extension 61 on one of the arms 58 to swing the platform up in the berth when there is a container on the platform ready for transfer out or to swing the platform down to lower container set into the car. Rollers 62 on bed 26 prevent scraping of bottom of container where they roll two under each side. Cylinder 60 is connected to air pressure tank AIR through spring returned pressure-exhaust solenoid valve 64, which is energized to pressure cylinder 60 to lift bed 26 by a circuit from positive of battery 66, limit switches 68 closed only when doors to container are closed, cam operated limit switch 69 closed by ramp rail 70 along where container should be lifted for transfer out in parallel with limit switch 71 closed when bed 26 is empty, solenoid of valve 64 to ground of battery 66. Platform 26 remains lifted when container is taken off until another container is set on. Guides 28 on the frame and partition 18 of car 14 guide the container into place in car and hold it from moving around on the car while people leave and reenter the container.

Referring again to FIGS. 1 and 2 where car 14 is pushing a container 16 up incline rails of track ST lifting the container out of the car as it moves forward, the velocity of the container carries it up the station ramp UP above the car and past a high HI from which track ST descends slightly to set the container on a belt-over-roller conveyor 72. If the velocity is not sufficient to carry the container over the top, one-way stops 73 spaced along sides of channels 30 extend in behind wheels 44 after recessing to let container pass and prevent the container from rolling back more than a few feet or inches. Stops 73 can be mounted on rod end of hydraulic cylinder driven to push a stalled container up over the top.

PASSENGER STATION

The passenger station TS, FIGS. 1–3 and 8–16, has a decelerating belt conveyor 72, a stop 74 a container length beyond, and an accelerating cable tow 76 for containers 16 along track ST from left to right. Container 16 is set by lift off rails of track ST onto left end of conveyor 72 running at substantially train speed. Conveyor 72 is then braked to stop the container and soon started to slowly move the container off end of conveyor 72 and against stop 74 to align gates 77 in partition 78 along platform P. A container 16 which has loaded at gates 77 for the train is accelerated by overhead cable 76 from stop 74 before the incoming container reaches gates 77. The outgoing container descends a slight dip CD to align in path for coupling car 14 and is brought up to safe coupling speed by cable accelerator 76 preferably just as it is coupled by train and is aligned for transfer and checked for alignment over empty berth before dip rails 30 can be lowered for transfer; otherwise it is run onto a safety stop track SST.

SAFETY STOP AT END OF STATION TRACK

Referring to FIGS. 1, 2, and 7, the outer rails 30' for dip DS are angles turned one leg up and one in hinged at 80 to underside of bottom leg in alignment at ends of channel rails 30 at head of the dip to swing down to slope shown in phantom to lower container 16 into car 14 but are normally held lifted level and latched at outer up-turned ends against bottom ends of aligned safety stop track SST sloped up to stop any container that did not align berth on car in time for transfer. Reverse motion checks 73 along sides of channel rails 30 prevent container from dropping back more than a few feet along the stop incline. The slope rail 42 is hinged at 82 to end of horizontal section and supported on extension through U-bracket 83 to slope DS to insert container but swings on hinge 82 up out of way to let container pass on rails 30' when held level to run up safety stop SST. This rail 42 then serves as a brake against the container, since the container must raise it in passing to the safety stop. Rail 42 is then preferably latched up by latch 84 until the container which lifted it is moved down from the safety stop by winch and back past rails of DS. The container changes its kinetic energy to height as it goes up track SST where it is held by a stop 73. The container is tilted forward at bottom along safety stop incline, which helps to keep people in balance while decelerating. With proper design and operation the safety track SST should never be used.

Rails 30' are held lifted by solenoid latches 85 on bottom end of each safety stop channel SST. These latches are released so rails 30' can drop to lower a container aligned to lower into car. Rails 30' are preferably suspended by springs or counterbalance rope reels 86 until weight of container lowers them to slope DS set by stop blocks 87 extending in from columns 34. After transfer, reels 86 lift rails 30' back up to be latched. There is no top leg to rails 30' of this hinged section, since front wheels 44 must leave them for transfer. Weight on rear wheels 44 of the container to be inserted forces rails 30 down to position shown in phantom as front wheel 46 rides rail 42 to hold container level. With this three-rail dip the container is inserted level straight down into car with much less chance of binding and closer alignment then if tilted.

Latches 85 are controlled by an alignment lamp 88 on car 14 which shines light up on photoelectric cells 89 above track ST when container is aligned above empty berth in car 14 passing these cells ahead of dip DS. Circuits for solenoid latches 85 will be described with FIG. 8 and for lamp 88 will be described with car circuits FIGS. 20 and 27.

STATION CONTROLS

Referring to FIG. 8, each car 14 has a dynamo DYN1 driven from its axle or motor to develop a voltage proportional to train speed. The output of dynamo DYN1 is connected across a grounded rail of track T and shoes 90 engaging control conductors 92 and 94 insulated from ground and each other and run along track T for a distance starting sufficiently ahead of the lift-off slope of track ST for conveyor 72 to be started and reach speed of incoming container before the container is set onto the conveyor 72 and preferably far enough ahead for the train to stop before transfer if conveyor 72 does not run. Signal light 95 is connected across generator 96 driven from belt of conveyor 72 for train to be stopped if light is not lit, or the container can skid to stop on conveyor 72. Conveyor 72 is shut off and braked when container is set on to stop container before reaching stop 74.

Controls for conveyor 72 include from rail 92, coil of relay 97 to ground and from rail 94, coils of relays 98 and 99 in series with rectifiers 100 and 101 respectively, to pass a negative and a positive current from DYN1 to line 102, bottom front contacts of relay 97, dynamo DYN2 to ground. Dynamo DYN2 is similar to DYN1 to develop voltage proportional to conveyor belt speed to equate speed same as DYN1, so relays 98 and 99 drop when speeds of car 14 and conveyor 72 are equal. Relay 98 closes a circuit from positive of battery 104, front contacts or relay 98, adjustable resistor 106, armature of permanent-magnet rheostat motor PM which drives wiper arms 108 and 109 of rheostat 110, in series to ground of battery 104. Relay 99 closes a circuit from negative of battery 104, front contacts of relay 99, resistor 106, motor PM to ground to reversely drive PM. When motor PM turns counterclockwise from off position of wiper 109 at bottom, conveyor 72 is started by circuit from positive of battery 104, line 112, line 114, line 115, top front contacts of relay 97, line 116, shunt field 117 of conveyor motor 118 to ground in parallel from line 114 with normally closed contacts of limit switches 120 in series to detect that no container is on conveyor 72, line 121, ring 122, finger 109 and resistance of rheostat 110, middle front contacts of relay 97, series field and armature of motor 118 to ground, to start conveyor 72 running to right as rheostat increases speed setting and adjusts for conveyor to run at train speed before container 16 is set thereon. When shoe 90 leaves rail 92 rheostat 110 is returned to off position by circuit from negative of battery 104, annular segments connected by finger 108 in all but off position, bottom back contacts of relay 97, resistor 106, motor PM to ground.

When a container is set on conveyor 72 successive limit switches 120 open from left to right as container moves along always opening at least one limit switch 120 to decelerate the conveyor by shutting off power to armature of motor 118, Shoe 90 on car 14 disengages rail 92 when container 16 is pushed up track ST and set on conveyor 72 thus dropping relays 97, 98 and 99 further disconnecting armature of motor 116 from battery 104 and connecting a braking circuit from ground through back contacts of time delay relay 126, resistor 128, top back contacts of relay 97, series field and armature of motor 118 to ground. The shunt field of motor 118 is then connected from positive of battery 104, line 112, line 114, normally open contacts of limit switches 120 in parallel to line 116, shunt field 117 to ground, to increase retarding force on conveyor 76.

Construction details of conveyor 72, FIGS. 9 and 10, include channel sides 130 turned legs out supported at ends on bottom flanges of cross beams 132 between posts 34 which support track ST, belt 133 run over rollers 134, on which the weight of the container on track ST above rests, and returned through slots 135 in beams 132 between sections of the conveyor. Every third roller 134 has its shaft 136 suspended through vertical slots 137 in channels 130 and is supported on springs 138 extending from tubular pockets 139 secured to web of channels 130 below slots 137. A vertical pin 140 secured on end of shaft 136 extends down through spring and pocket to operate limit switch 120 secured below so weight on roller depressing shaft 136 and pin 140 operates the limit switch.

When shoe 90 engages rail 94, which runs through station to end of container accelerating run at end of cable way 76, doors 24 on container at stop and partition gates 77 are controlled by circuit from rail 94, line 141, coil of relay 142 to ground. Relay 142 closes a circuit from positive of battery 104, line 112, front contacts of relay 142, door operators 144 to ground to close doors 24 and gates 77 as per FIGS. 50–53 of my U.S. Pat. No. 3,956,994.

A start timer 146 is connected in parallel with coil of relay 142 to start timing from when shoe 90 engages rail 94. Timer 146 is driven at speed approximately proportional to train speed to time an interval approximately inversely proportional to train speed. At the end of this time interval, timer 146 closes a circuit from rail 94, line 147 to timer segment 148, finger of timer 146 making contacts from 148 to line 149, contacts of door and gate closers 144 closed in series when all doors and gates to the container to leave the station are closed, top coils of stick relays 150 and 151 in parallel to ground rail to dynamo DYN1, lifting relays 150 and 151 only if the doors and gates have been closed before the end of the time interval. The timer finger continues to turn counterclockwise opening its contacts and is thereafter held by electromagnet 152 connected between line 147 and ground, so that timer contacts cannot reclose while line 147 is live after the time interval for starting is past. Relay 150 is held lifted by circuit from rail 94, line 147, top front contacts and lower coil of relay 150 to ground. Relay 151 is held lifted by circuit from positive of battery 104, line 112, front contacts and bottom coil of relay 151, normally closed contacts of limit switch 154 about a container length from the stop cylinder 74, solenoid of valve 156 to ground, connecting air pressure from supply AIR through valve 156 to rod end of stop cylinder 74 to retract the stop extended by spring within the cylinder. When solenoid valve 156 is energized, stop 74 is retracted so the cable drive 76 can move the container from gates 77 and accelerate it to coupling speed. The outgoing container 16 opens limit switch 154 deenergizing valve 156 so stop 74 lifts to stop incoming container 16 against stop 74. Relay 151 is also dropped by the opening of limit switch 154 in series with its holding coil and drops, since its lift coil is then open at timer 146.

If the start timer 146 does not connect its wiper to segment 148 before train is within about thirty feet of container on stop 74, shoe 90 then engages a rail 160 connected to segment 162 ahead of segment 148 on timer 146 to start container for slow train (less than twenty miles per hour) so container can run down coupling dip CD ahead of coupling position with car 14. This provides for the container to be started soon enough for slow train and late enough for fast train to couple container as soon as coupling speed is reached thus reducing length of station track needed.

The preferred accelerator (FIGS. 1–3, 8 and 11–14 is an endless wire rope tow 76 which has snubber 163 and dog 164 secured on the rope for pushing a container from station stop 74 along track ST nearly to end of coupling run so car can couple bottom of container anywhere beyond CD along the run and accelerate and align it for transfer thereto. Two wire messenger ropes 166 are run each side of central accelerating rope 76 and connected thereto with short pieces of rope or H-shaped hangers 167 with ends imbeded one in a rope 166 and one in rope 76 to suspend the accelerating rope. Ropes 166 and 76 are run over three vertical sheaves 168 on shaft 169 mounted in take-up frames 170 on top of channels 30 a container length ahead of the station stop 74, and these ropes run parallel over three grooved pulleys 172 keyed on shaft 173 supported in bearing pedestals 174 secured to tops of channels 30 at end of acceleration run. Ropes 166 and 76 run centered between channels 30 with rope 76 in middle. Ropes 166 are supported on sheaves 176 secured on top along channels 30 for both outgoing and return runs. A few of these sheaves are mounted above ropes 166 to dip them at CD. Sheaves 176 are transversely spaced in pairs so rope 76 hangs down below ropes 166 along the runs out and back.

Snubber block 163 just ahead of dog 164 rests against top of projection 47 on rear of container as the rope 76 runs down around center sheave 168 to keep container from bounding ahead of the dog, yet frees container to accelerate when coupled by car. Snubber block 163 and dog 164 are preferably molded neoprene to cushion engagement. Snubber wheels 178 hold rope 76 down to insure dog is engaged from starting end through dip CD. Sheaves 168 and pulleys 172 are spaced on their shafts so connecting hangers 167 lie substantially straight between so all ropes travel equal distance when driven. Center pulley can be slightly larger since center rope is slightly longer and should carry the load without slipping behind the other ropes. A gear motor 180 is connected to shaft 173 through spring coupling 181 to drive the ropes and further cushion container from this drive.

Gearmotor 180 has a shaft extension to drive a dynamo DYN3 to develop the same voltage as DYN1 when rope 76 is driven at a safe coupling speed less than the train. Dynamo DYN3 is connected in circuit from DYN1, shoe 90 engaging rail 94 all the way through station to end of tow 76, line 182, coils of relays 184 and 185 in parallel and each in series reversely respectively with rectifiers 188 and 189 to pass respectively positive and negative current to dynamo DYN3, to ground rail to DYN1, to lift relay 184 or 185 according as rope 76 has speed less or greater than a speed well within speed for container to be safely coupled by the train.

A rheostat for controlling motor 180 of ropeway 76 is driven by permanent-magnet gearmotor PM2 from off position shown, by a circuit from positive of battery 104, line 112, second from bottom front contacts of stick relay 150, front contacts of relay 184, armature of motor PM2 all in series to ground, turning the rheostat wipers 191 and 192 counterclockwise, closing circuits from positive of battery 104, line 112, next higher front contacts of relay 150, annular segment 193 soon connected by wiper 192 to segment 194, line 195, shunt field of motor 180 in parallel with top coil of time-delay stick relay 126, to ground. As rheostat 190 turns further its finger 192 connects series field and armature of motor 180 through resistance of the rheostat across battery 104 (or other suitable power source) and slowly reduces resistance to accelerate the outgoing container to coupling speed. The rheostat is stopped when relay 184 drops when the leaving container reaches the coupling speed and is reversed by lifting of relay 185 connecting a circuit from negative of battery 104, line 198, bottom front contacts of relay 150, PM2 to ground, to increase resistance in series to slow rope 76 if it accelerates beyond a narrow coupling speed difference well within safe speed difference with respect to the train's speed.

After a time delay to allow outgoing container to move past stop 74, dashpot relay 126 closes contacts to move container waiting on conveyor 72 to station stop 74 by circuit from positive of battery 104, lines 112 and 114, normally open contacts of limit switches 120 closed by the container to line 116, shunt field of motor 118 in parallel with bottom series coil and front contacts of delay relay 126, adjustable resistor 200, top back contacts of relay 97, series field and armature of motor 118 to ground, to operate conveyor 72 at low speed according to setting of resistor 200, to move incoming container 16 off of conveyor 72 and against stop 74.

During this time the outgoing container is accelerating to coupling speed and runs at this speed until coupled or to end of rope way 76 and coasts into stop SST. If rope 76 exceeds coupling speed, DYN3 is developing higher voltage than DYN1 and relay 184 has dropped and relay 185 lifts reversing PM2 to return rheostat 190 to increase resistance in series with motor 180 to slow the rope to coupling speed. Rheostat 190 is held at correct setting for coupling speed when the voltage output of DYN1 and DYN3 are equal at the coupling speed difference, dropping relays 184 and 185. For details of this and related speed control and check circuits see my Pat. Nos. 3,037,461–2, 3,038,066, and FIG. 38 of 3,483,829.

When shoe 90 leaves rail 94, timer 146 is reset by its spring, and relay 150 drops completing a circuit to return rheostat 190 to off position. This circuit is from negative of battery 104, line 198, back contacts of relay 150, annular segments connected by wiper 191 in all but off position of rheostat 190, armature of PM2 to ground, returning motor PM2 clockwise to off position.

After the acceleration run, shoe 90 leaves rail 94 and engages a short rail 202 to lift a stick relay 204 held by circuit from positive of battery 104, lines 112 and 114, normally closed limit switch 206, front contacts and holding coil of relay 204 to ground. Relay 204 closes circuit from positive of battery 104, line 112, its middle front contacts to shunt coil of motor 180 to ground and from line 112 through its lower front contacts, adjustable resistance 208, series coil and armature of motor 180 to ground, to return dog 164 around top nearly to start position where the dog opens limit switch 206 to drop relay 204 to shut off power so dog coasts to lightly engage container at stop 74.

The safety dip switch rails 30' are controlled by photoelectric cells 89 connected through amplifier across coil of relay 210 to close circuit from positive of battery 104, line 112, line 212, front contacts of relay 210, latch release solenoids 81 to ground to release rails 30' to lower container into empty berth aligned below.

Referring to graph, FIG. 15, where distance along station is ploted as absissa against container and train speed as ordinate respectively above and below line 0. Conveyor 72 is longer than needed to stop container from fastest train even if the container skids thereon before reaching stop 74. Deceleration curves DC for containers set on conveyor 72 at 10, 20, 30, and 40 miles per hour are labled 10DC, 20DC, 30DC, and 40DC respectively. At 10 miles per hour container is stopped in short distance compaired with distance at 40 miles per hour and has longer slow speed run to station stop. Container shown at station stop is started after time delay inversely proportional to train speed above 20 miles per hour, during which time train moves from line TS to point horizontally in line on start time delay curve STD. The containers can be accelerated approximately eight miles per hour per second to coupling speed graphed as speed vs. distance line AC. The initial acceleration is preferably much less to let passengers brace from leaning during high acceleration in paded container. The distance needed to reach coupling speed for 10 mile per hour train is much less than needed for 40 mile per hour train as seen by curve AC. In this acceleration time train moves from point on line STD horizontally to point on coupling curve CC. Alignment should be reached where acceleration curve AC intersects line for train's speed. Container for 40 mile per hour train runs near full length of ropeway to reach coupling speed and couple, while container for 20 mile per hour train reaches coupling speed in much less distance where it couples and pulls ahead of dog 164, which continues at coupling speed until shoe 90 leaves rail 94. Container for train at less than 20 miles per hour is started early (thirty feet ahead of stop 74) to insure being ahead of coupling and couples after a run at coupling speed as curve CC shows by breaking away from coupling speed curve CS. The length of the station track depends on maximum train speed for coupling, deceleration and acceleration rates for container plus allowance for variations. Distances are shown for 40 mile per hour maximum train speed with 8 miles per hour per second deceleration and acceleration rates. If a container runs beyond ropeway 74 without being coupled to train it coasts and if not coupled and aligned before the transfer dip it runs up safety stop SST. The length of the transfer slopes depend on maximum train speed and passenger tolerance; about 60 feet long for 8 foot vertical change is considered sufficient.

COUPLING CARRIAGE FOR RAILWAY CAR

Referring to FIGS. 16–22, railway car 14 has container berth 17 midway its length along one side, two channel rails 220 turned legs in along roof 222 and secured to frame of car 14, a coupling carriage 224 having flanged wheels 226 which run between legs of channels 220. Carriage 224 (FIGS. 21–22) has an open rectangular frame of flats 228 standing on edge along sides between bearing blocks 229 connected by flats 230 below axles 232 having a wheel 226 on each end with outer face about flush with flats 228 and a latch 234 on each axle 232 for engaging container 16 between when met by car 14. The container is passed through the opening in frame of carriage when inserted or withdrawn from the berth. Each latch 234 has a roller 236 mounted between two parallel arms 238 extending up by spring to about 30° against engagement with flat 230 so as to recess for latching. The carriage quickly lines up the container with berth 17 so the container can be set in by dip DS in track ST.

The carriage is connected by a rope 240 at each end run endward around horizontal sheave 242 at each end of car and run back over vertical sheave 244 at the end of the berth and down around and between drums of catapult 246 and on to anchor on cylinder 248 or on frame of car 14. Ropes 240 from opposite ends of the carriage are thus run to a catapult 246 at opposite ends of the rod of cylinder 248 whose rod extends through the cylinder to actuate a double catapult 246 for the carriage, to move and follow movement of the carriage, so the ropes are always reeled up and not drooping. Cylinder 248 is filled with hydraulic fluid connected by tubing from opposite ends separately to opposite ends of a duplicate cylinder 252 through restrictive orfice 254 and a constant pressure relief valve CP so the piston of cylinder 252 follows movement of the piston of cylinder 248 and vice versa. Cylinder 252 also has a through rod. One end of this rod is connected to piston of air cylinder 256, opposite ends of which are connected through three-position double-solenoid valve 258 to AIR or exhaust according to which solenoid is energized or both exhausted in spring-centered neutral when neither solenoid is energized.

Solenoids of valve 258 are controlled by circuits shown in FIG. 20 where the bottom solenoid is energized by a circuit from positive of battery 66, normally closed contacts of limit switch 260 opened by carriage 224 at forward limit of travel, normally closed contacts of limit switches 262 spaced less than container length apart along top of a channel 220 to be opened by container anywhere along roof, normally closed contacts of limit switch 264 opened by container in berth, all in series to line 266, lower solenoid of valve 258 to ground to lift spool of valve 258 to let air enter bottom port to lift pistons of cylinders 252 and 256 and shift piston of cylinder 248 rearward to move the empty carriage forward until limit switch 260 opens when the carriage is at front to receive a container for maximum cushioning travel upon impact, pushing the carriage back, shifting fluid from front end of cylinder 248 to top of cylinder 252 through relief valve CP and orfice 254 to provide a substantially constant force against the container to accelerate it steadily to train speed. If the container on the carriage reaches train speed before it aligns the berth, ie. stops on front portion of roof, a limit switch 262 ahead of berth 17 closes a circuit from positive of battery 66, line 268, normally open contacts of limit switches 262 ahead of berth 17 in parallel to line 270, coil of approximately a one-second time delay relay 272 to ground in parallel with front contacts of relay 272, top solenoid of valve 258 to ground to shift valve 258 to pressure cylinder 256 to force fluid from bottom of cylinder 252 to rear of piston of cylinder 248 to shift catapult rod forward pulling carriage back until these limit switches ahead of the berth are passed by the container, deenergizing solenoid of valve 258, which shifts by springs to neutral to hold the carriage with container aligned above berth 17. If the carriage moves behind the berth, a limit switch 262 closes a circuit from positive of battery 66, line 270, normally open contacts of limit switches 262 behind the berth in parallel to line 274, bottom solenoid of valve 258 to ground, to shift catapult rod toward rear until these limit switches are cleared by the carriage moving the container forward to align with the berth.

When the carriage aligns a container for transfer over empty berth, alignment lamp 88 is lit by circuit from positive of battery 66, normally closed contacts of limit switches 262 at each end of berth opening, normally open contacts of the limit switch 262 at berth opening, contacts of limit switch 264 opened by container in berth, lamp 88, all in series to ground to direct light up to photoelectric cells 89 a few yards ahead of the transfer dip DS. When cells 89 receive this light they lift relay 210 connected through amplifier thereto to close circuit (described with FIG. 8) to release latches 85.

When a container is set down in berth on bed 26 it opens limit switch 71, deenergizing solenoid of valve 64 to release pressure from cylinder 60, lowering bed 26 with container 16 to position FIG. 19 for entrance and exit of persons between the container and car 14. The container is set down to where wheels 44 rest on bottom legs of channels 220 through opening in top legs of these channels.

So that containers can stay on cars longer to complete unloading and loading, especially where stations are closely spaced, cars 14' have berths for more than one container for alternate transfer at successive stations, and these berths or the single berth can be along center of car as well as at side, as seen from FIGS. 23–26. The carriage 224, FIGS. 21–22, 25–26 and 29–31, is the same whether berths are along side or center of car and is run above container inserted into car if the car has more than one berth, so the carriage can position an incoming container over an empty berth behind a full berth and run over the full berth.

For car 14', FIGS. 23–24, which has two berths on center, two lifts 26 are provided and carriage controls modified per FIG. 27. A rope 240 is secured to each end of each side of carriage 224 and run separately to and around a sheave 242 at end of car and back over a vertical sheave 244 at end of berths 17 and down around drums of a double catapult 246' to anchor on end of cylinder 248 or frame of car 14' below and along each side of the berth area. Cylinder 248 operates all four catapults 246' to haul ropes 240 on each side of car in synchronism. Cylinder 248 is similarly connected to cylinder 252 by valves CP and restriction 254, and hydraulic cylinder 252 to air cylinder 256, controlled by solenoid valve 258 as in FIG. 20. The circuits for valve 258 are changed to operate the carriage for filling the front most empty berth first and removing the front most container ready for removal. A lamp 280 shines light across each berth to photoelectric cell 282 to lift a relay 284 to detect a container raised up partly or fully above each berth. A circuit including this check is closed from positive of battery 66, normally closed contacts of limit switch 260 opened by carriage at front to stop carriage thereat, normally closed contacts of limit switches 262 spaced along top of rail 220 to detect container along roof ahead of berths, front contacts of relays 284 closed by lamps 280, limit switches 262 spaced at less than container length on top of rail 220 behind the berths to detect container behind the berths, line 274, bottom solenoid of valve 258 all in series to ground of battery 66, to shift valve 258 to pressure cylinder 256 to shift cylinder 252 to shift rod of cylinder 248 to rear to pull carrier to front of car to position for receiving container when roof track is clear.

When a container is coupled a circuit is completed from positive of battery 66, line 268, normally open contacts of limit switches 262 ahead of berths in parallel to line 270, coil of time delay 272 to ground, and in parallel from line 270, front contacts of relay 272, top solenoid of valve 258 to ground to move carriage backward after about a one-second time delay, and from line 268 normally open contacts of the limit switch 262 closed by container straddling over the berths, line 288, normally closed contacts of limit switch 264 opened by container in first berth, line 266, bottom solenoid of valve 258 to ground to move carriage with container forward from between berths to align first berth, and from line 288 normally open contacts of the limit switch 264 for first berth, normally closed contacts of limit switch 264' closed when second berth is empty, top solenoid of valve 258 to move carriage with container straddling berths backward to align second berth if first berth has container and second berth is empty, and from line 268 normally open contacts of limit switches 262 behind second berth in parallel to line 266, bottom solenoid of valve 258 to ground to move carrier forward from rear of car.

Alignment lamp 88 is lit by circuit from positive of battery 66, line 268, front contacts of relay 290, lamp 88 to ground. Relay 290 is closed by circuit from line 268, normally closed contacts of limit switch 262 just ahead of container when aligned over first berth, normally open contacts of limit switch 262 closed by front edge of container aligning first berth, normally closed contacts of limit switch 264 opened by container in first berth, coil of relay 290 to ground, and from line 268 normally closed contacts of limit switch 262 just behind second berth, normally open contacts of limit switch 262 at rear of side of container aligned over second berth, normally closed contacts of limit switch 264' closed when second berth is empty, coil of relay 290 to ground to light lamp 88 when a container on the carriage is aligned over an empty berth.

After a container is coupled and aligned over a berth by the carriage and inserted into the berth by dip slope DS of track ST it is lowered on platform 26. When the incoming container is lowered to bottom of berth lamps 280 lift relays 282 completing circuit to move carriage to front of car ready to receive next container.

Containers are removed from car 14' by lifting on a platform 26 for each berth, FIGS. 23 and 24, while carriage is at front of car. There is no interference from ropes 240, since they run along side the opening for the container and preferably inside channels 220 of the roof track.

Container 16 recesses below carriage 224 into car 14' as seen from FIGS. 25 and 26. Outboard wheels 44 on container rest in pockets 292 below and inward from rails 220. These Figures also show the arrangement of lamps 280 to direct light to cells 282 to detect container in berth.

Air cylinder 256 builds up pressure as the carriage is forced back by engaging a container traveling slower than the car as shown by curve AP, FIG. 28, while hydraulic cylinder 248 is relieved through valves CP at constant pressure to apply even accelerating force HP to container caught on fly by carriage. The air cylinder restrains a container caught at excessive speed difference from running too far back on car 14 or 14' by building up extra pressure, curve AP, for faster acceleration of the container in that situation. The hydraulic bleed valves 254 reduce force and help prevent too quick an increase in acceleration of the container.

The carriage should be built as light in weight as practical to reduce impact force needed to set it in motion. The container can be weighted, ballast added, to help prevent shock acceleration from impact. The catapult and cylinders move very little relative to travel of the carriage and so take relatively little additional force to be set in motion. The initial impact force would be taken by stretch of ropes 240 and preferably by shock absorbers on couplers 234 or on the containers.

Referring to FIGS. 29–31, containers 16 preferably have a shock absorbing bumper 294 on the rear where engaged by the carriage. A shock absorbing cylinder 295 is secured below floor of container with rod parallel length of container on center. An angle 296 secured transversely on end of the rod is engaged by roller 236 on rear coupling of carriage 224 and recesses the shock absorber to accelerate the container when engaging as in FIG. 31. The front coupler roller 236 of the carriage engages in trough of a front angle bumper 296 on the container to keep container from bounding ahead of carriage when engaged by carriage which decelerates to container speed moving back along roof of the car. The carriage with the added cushioning of the container by shock absorbing bumper 294 should take ten miles per hour speed difference between full scale car and container without exceeding eight miles per hour per second acceleration of the container.

SOME VARIATIONS OF STATION TRACK WITH CONTAINERS OR CARRIERS

The station track and container or carrier wheels can have any of several arrangements. The variations shown in FIGS. 32–40 are parts which can be substituted for corresponding parts in FIGS. 1–31 and need other parts of the system to function.

Referring to FIGS. 32–34, container 16' has two outboard wheels 44' at front and two farther out at rear. Station track ST2 for this container is outboard the sides of the container with separate rails **30*f* and 30*r* for respectively front and rear wheels on each side of container 16'. Rails 30*f* for front wheels run up lift-out incline US, along the station run, and down the insertion ramp DS the wheel base distance WB ahead of rails 30*r* which have the same profile for the rear wheels 44' to maintain the container level during lifting and lowering. At start of the down slope the front wheels run out on a teeter switch, lever 300, pivoted on pin 302 to supporting member and weighted to tilt to position shown in FIG. 33 to position for front wheels 44' to run out on the switch to point above pivot 302 and therebeyond tilt the switch down in front for the front wheels to start down the slope and lift the rear of the switch open as in FIG. 34 so rear wheels 44' to wider gage can run down outer track rails 30*r*. Wheels 44'** are shown as V-grooved on angle rail but could just as well be flanged to run on T-rail or channels.

Referring to FIGS. 35 and 36 where the container 16' is reversed with the wide gage forward to run station track ST3. This track has a trap-door type switch 310 on inner rails **30*r* at top of up slope US for forward outer wheels 44' to pass up the outer rails 30*f*, opening switches 310 in the inner rails from underneath, which drop back before the rear wheels 44'** run over these switches on the inner rails. The down slope DS requires no switches.

Referring to FIGS. 37 and 38, the suspending wheels 44 of container 16'' are outboard to one gage (or as shown with different gages front and rear) but at different elevations, front two from rear two with higher wheels at rear, resulting in station trackage ST4 with trap-door switches 310' in top rails **30*r* at top of down slope. This track has double levels of track along horizontal runs, which takes more rail than the previously described arrangements. The front wheels 44 on rail 30*f* swing up trap-door switch 310' in higher rails 30*r* to come out from under these rails where the dip DS is approached and lets switches 310' swing closed before the rear wheels 44 run over these switches and down onto track 30*fr* which carries both front and rear wheels 44** on the two-rail down slope which compensates for difference in elevation between front and rear wheels to support the container level and save some rail.

The station track ST5, FIGS. 39 and 40, is for container carriers 316 with rear wheels 44 positioned higher than front wheels 44 and to narrower outboard gage than the front wheels 44. A trap door switch 310' lets carrier's front wheels 44 out from under track **30*r* for the rear wheels. This carrier has a frame three-container-lengths long supported along track ST5 on outboard wheels 44 and is inserted in car 14'' on track T to run between stations in the car and is removed by station tracks ST5 for station stop and reinserted in next train 12 as shown. Containers 16''' are held in the carrier by hooks as in my U.S. Pat. No. 3,939,775 titled OVERHEAD TRANSFER CARRIER AND TRACKS and are released by the car while another container 16''' in the car and under the carrier is engaged for withdrawl to the next station to leave containers 16'''** on the train longer for more time to unload and reload for stations closely spaced.

Each of these station tracks can have a safety stop switch DS and incline track SST with reverse motion stops 73 on exit end. Switches DS are for transfer as taught with FIGS. 1, 2, 8, 20 and 27.

FREIGHT AND PASSENGER CONTAINER STATION

Referring to FIGS. 41–46, mixed passenger-freight train 12PF on track T is shown passing station TS' nonstop from left to right with one or more freight container cars 14F and passenger container transfer cars 14P therein. Station TS' has an overhead station track ST' for container carriers 316P and 316F for respectively transfer of passenger and freight containers 16P and 16F between trains and the station.

The freight and passenger container carriers have a rectangular frame 320, as seen in plan FIG. 42, with wheels 44 outboard from sides on projections 45 on top of frame 320 and wheels 46 offset equally and oppositely from center at ends on pedestals 47 on top of the frame, similar as on top of container 16, or the carrier can have a swivel truck at each end as will be described with FIGS. 61–64. Wheels 44 run in channel rails 30, and inboard V-grooved wheels 46 positioned only on opposite sides of center at each end run on angle 50 turned legs down along top of bottom leg in channels 40' on end of carrier facing out over the dip along slopes DUS. Channels 30 and 40' are supported by cross beams or tubes 32 supported on columns 34 like track ST but of wider gage for wider containers 16F.

Station track ST' has two transfer runs TR in succession each over a straight section of track T. The first transfer run according to train direction is for unloading and the second for loading the train from either direction. Each transfer run TR has a double dip DD for level transfer of passenger and freight containers to or from the train according to direction of travel of train. At each double dip, rails 30 run down and up identical dip slopes DUS separated by a substantially level section of at least twice the wheel base of the carriers between the bottoms of the dip slopes DUS, and a rail 40' runs out over each slope DUS off center equally as seen looking down each slope to support end of carriers level out over slopes DUS.

The station track is preferably in form of rectangular loop with double tracks on a side of the loop along track T with offset near middle for each of the double tracks to make a transfer run TR over track T in succession. The station track includes a classification yard CY with station tracks STC run generally parallel track T between ladder tracks STL in ends of the loop. The classification yard provides tracks STC each for assembling carriers 316F loaded with containers 16F for trains on a particular route and one or more tracks STC for empty containers 16F and one or more tracks for passenger and express etc. containers which are stopped at platform P'. Each train 12PF signals ahead to station its route so containers for that train can be moved on the carriers from their classification track to head of second transfer dip and a string of empty carriers moved from another classification track to head of first dip according to train's direction of approach. Switches 324 in tracks ST' and ST are as in FIG. 2 of my U.S. Pat. No. 3,483,829 and can be controlled electrically by pushbuttons or when set to operate from route signals from approaching train to open storage track having carriers with containers for the train so these carriers can be pushed out onto the ladder track at end toward approaching train and moved to head of second transfer run by a tractor 328 which runs on track ST' or by other means such as a vehicle on the ground or propulsion rails PR or rope haul RH along track ST'. From there the carriers are pushed by a ropehaul RH against stop 330 at head end of second transfer run according to train direction. Likewise empty carriers are pushed out from a classification track onto the same ladder track by tractor 328 or other means and switched to first transfer dip track and pushed to head of the transfer dip by a ropehaul above the track.

A gantry track GT with one or two transfer gantries G thereon is to right of yard CY. One or more tracks ST' extend from front and back tracks of the station loop and curve to align a section of track STG on each of the gantries to shuttle carriers 316F and 316P with containers to and from track ST' and vehicles or storage spots below the gantry or tracks STS along side gantry run to align track STG for sorting containers for different train routes or for short time storage for delayed or local delivery. Carrier storage tracks STS are positioned along part of the gantry run to store carriers with or without containers, handy for transfer of containers to and from trailers and trucks parked below the gantry. The gantry has hoisting legs 332 for loading and unloading trailers and trucks MT and for utilizing ground or pedestal storage area SA between rails of the gantry track. The track STG on the gantry aligns with the main station track ST' across gap in track ST' or aligns with tracks STS for transfer of carriers on and off the gantry. The gantry can be used to classify containers to tracks STS each for a particular train route and the carriers moved across switches 324 to track ST' and on to the classification tracks STC to wait for their train.

The freight carriers 316 are sized to take one container 16F and cars 14F to carry two or more containers 16F. Carriers 316F and 316P each have a short column 334F and 334P and a long column 336F and 336P respectively depending from each end of frame 320 with hooks 338 at elevation and spaced to engage under sides of the cargo containers or in pockets 339 on ends of the passenger containers. The longer columns 336F and 336P are at diagonally opposite corners of frame 320 of carriers 316F and 316P and extend below a container on the carrier (See FIG. 47) to be coupled only by car 14F or 14P respectively, since columns 336F are transversely outwardly spaced beyond coulums 336P. Columns 336F are reinforced by vertical angle 340 turned vertex out endward along where engaged by couplings on cars 14F and opposite side reinforced by square tubing 342.

FREIGHT CARS

Cars 14F are typical railroad flat cars with two retractable vertical couplings 234F each at a diagonally opposite corner of each berth, on right side of berth as viewed facing outside end of berth and controlled to both extend together to engage columns 336F on a carrier 316F to latch the carrier between the couplings 234F to position the carrier for container transfer over either berth on car 14F and move the carrier along with the car. Couplers 234F each have a V-groove wheel 344, FIGS. 48 and 49, loose on shaft 346 between top ends of two parallel latch arms 348 connected on pin 350 at bottom to bracket 352 secured in top of rectangular tube 354 guided in lower tube or channel 356 having ends of legs turned in along their length and pivotally secured to bracket 358 on bed of car 14F at left-hand corner of each end of each berth. Coupling columns 356 are each braced upright by a shock absorber, spring cylinder 360, pivotally connected at rod end to channel 356 and at head end to bracket 361 secured to bed of car 14F along side the berth to let coupling swing back slightly when engaging carrier to reduce coupling shock. An air cylinder 362 is connected between each channel 356 and tube 354 therein. Cylinders 362 for each berth are connected and controlled to extend both couplings together when coupling is required and one carrier length ahead of the transfer dip until one carrier length beyond the return up from the dip. Couplers 234F with channel supports and controls are similar to those of FIGS. 5 and 8–15 of my U.S. Pat. No. 3,956,944.

PASSENGER CAR

The passenger car 14P has a central berth 17P separated by partition 18 from an aisle 20 on each side of the car providing access to train facilities and seating. Doors 24 into the enclosed container 16P align doors 22 in partition 18 when container is down in car 14P. Berth 17P has no container lift as does car 14. A vertical latching coupling 234P resiliently secured to roof framing of car 14P at each end of the berth off center equally and oppositely at each end of berth is extended up by air cylinder 362' when safe for transfer to engage depending columns 336P of carrier 316P therebetween at a low train speed a carrier length ahead of the double dip.

Hooking columns 334P and 336P each have a retractable hook 338 for engaging in a pocket 339 on each side of each end of the enclosed passenger container 16P. Diagonally opposite columns 336P extend down below container 16P on the carrier 316P to be engaged between extended vertical coupling latches 234P when the carrier is aligned over berth 17P. The bottom of columns 334P and 336P are tapered in at bottom toward container to align carrier on container in car. Ends of the container are curved in endward at top and bottom to further encourage engagement with carrier and car respectively. The opening in roof of car 14P into berth 17P is tapered out and up to help guide columns and container into the berth. Latch couplings 234P have side arms 348' flaired out and central V-grooved roller 344 to guide and track it on coupling columns 336P and are otherwise as described in my U.S. Pat. No. 3,956,944, FIGS. 42–46, and are extended to couple carrier at head of transfer run. It is preferred that they be retractable by air cylinder (not needed if precaution is taken with only one car 14P per train ahead of any cars 14F) so not to engage a carrier which is not at first place at head of the transfer run by same control as for cars 14F.

The container in car 14P is removed on first dip and another inserted in the berth on second transfer dip at each station for maximum use of the berth space on the train. If station had only one dip for both loading and unloading the car or train would need two berths and alternate ones would be empty between stations. The cars 14P can have a plurality of container spaces for private containers for various accomodations such as roomettes, berths, etc. as well as for transfer of people to and from train with passage to use other accomodations on the train. Such a railway car can have a row of berths along each side with aisle between as in my U.S. Pat. No. 3,456,949, FIGS. 118–120, wherein container hooks are controlled selectively but with carrier and station tracks revised to this present invention.

CONTAINER HOOKS

Hooks 338 on columns 334F, 334P, 336F, and 336P for engaging containers on the carriers are preferably as shown on columns 334 and 336 in FIGS. 50–51 and 52–55 respectively and made from two hook plates 368 connected by spacer block 369 at tooth 370 or the hook can be integral with deep slot at top between the sides 368 of which the rod end 371 of dashpot cylinder 372 is connected by pin 374 preferably extending beyond sides into slots or pockets 376 to travel up and down in sides of the columns 334 or 336 and to support the hook and load at lower end of travel. At least one side plate of hook 338 extends above the rod end to be an opening arm 378 and is forced back by ingaging bottom of cylinder 372 to force the hook tooth below the pivot 374 out to extend hook tooth as in FIG. 50 to position for latching to a load. The hook plates have bottom face tapered back from hook tooth and fit between sides of column 334 or 336 through opening in connecting side so hook can swing between the sides of column after being relieved of a load to prevent catching on the load. Preferably a spring 380 is secured tight between pins 382 between depending sides of the hook column and extends to and engages back of hook 338 in line with pin 374 when hook is in normal position (lifted with no load) as shown in FIG. 50. When the hook latches on a container and is lifted the weight of the container pulls the hook down preferably until pin rests on bottom of slots 376 in tube 334 or 336 or optionally until the piston of dashpot 372 rests on ledge 384 inside the dashpot to carry the weight and compresses spring 386 of the dashpot into lower area of the cylinder.

Spring 380 is then engaging top end of arm 378 trying to force the hook open but cannot because tooth 370 is caught up under the load. When the load is relieved from the hook, as when set down the hook tooth disengages the load and swings clockwise in behind shielding sides of the column by action of gravity preferably aided by spring 380, so hook will not catch when lifted, FIGS. 51–54. The hook is held open by dashpot 372 time for hook to be lifted from load that is released. The ends of dashpot 372 are connected by check valve 388 and needle valve or bleed 390 to let dashpot extend down quickly when its hook engages a load and the carrier lifted but returns up slowly toward latching position, FIG. 50, after being relieved of load until the piston of the dashpot uncovers a port 392 about halfway to head end in the dashpot to quickly return the hook up to swing out to latching position.

All hooks for engaging a container are preferably connected to operate together as shown by FIG. 56. The head ends of air cylinders 372 are connected by tubes 394 to head end of cylinder 396 and through check valve 388' in parallel with orifice or needle valve 390' to rod end of cylinder 396. The rod ends of cylinders 372 are connected by tubes 398 to rod end of cylinder 396. The piston of cylinder 396 is forced toward rod end by spring 400 in head end chamber to lift all hooks. Hooks 338 are each opened by a hydraulic cylinder 402 (replacing spring 380 but suplementing gravity) connected from rod ends by fittings and tubing 404 to air dome accumulator 406 and to rod end of cylinder 408 whose rod extends up integral to rod of cylinder 396. Cylinders 402 are mounted one above each cylinder 372 with rod extending down along side and under cylinder 372 to lift arm 378 to recess the hook open when cylinders 402 are pressured. When hooks 338 engage a container and carrier is lifted the hooks extend cylinders 372 passing fluid to rod end of cylinder 396 and compressing spring 400, forcing fluid from rod ends of cylinders 402 and fluid from head end of cylinder 408 to accumulator 406 to pressure rod ends of cylinders 402 so when container is set down hooks 338 are forced to recess, FIG. 51, by air pressure in accumulator 406 forcing rods of cylinders 402 against arms 378 to swing hooks 338 away from bails and between, sides of supporting column. Spring 400 in dashpot 396 trys to force fluid to rod ends of cylinders 372 to lift hooks 338 but is controlled by valve 390' to give time delay before port 410 is opened bypassing check valve 388' to quickly swing the hooks from behind shields to engaging position. This automatic hook enables the carrier to transfer container to or from car moving carrier through the transfer dip with no signal or controls or change in elevation to determine what the hook should do as required by my previous automatic hooks. By providing a separate carrier for each container berth on car 14F each empty carrier coupled to car is to remove container and each carrier having container when coupled for dip is to deposit the container on the car thus simplifying control by eliminating the situation where an empty carrier berth is aligned over container which is not to be transferred to that carrier, a complication of my prior system now simplified.

HOPEWAYS AT FREIGHT AND PASSENGER STATION

Referring to FIGS. 41 and 57–60, a ropehaul is provided at each end of each transfer dip to feed carriers 316P and 316F to the dip stop 330 for a transfer run for trains from one direction or push carriers along to ladder track STL for tractor 328 to sort to classification tracks STC after the transfer runs for train from opposite direction.

An endless wire rope 420 is run over grooved pulleys 422 each secured on a shaft 424 bearing mounted transverse above track ST' at ends of the ropeway. The rope is supported on pairs of skate wheels 425 mounted on ends of short shafts 426 connected transversely to bottom of rope 420 along bottom run (ie. to top of rope along top run) by bracket 427 formed of two stiff wires radiating from shaft 426 at about 60°–90° at center and extending into bottom of rope 420 along bottom run, which would be above the rope along top run. Wheels 425 run in channel rails 428 secured central between and over channel rails of track ST' between end pulleys 422 and guide the rope around curves in track ST'.

Pusher dogs 430 are mounted to rope 420 preferably at carrier length plus clearance intervals. Each dog 430 is a double ended latch bar pivotally secured at center on every third shaft 426 between wheels 425 and connected from center by rod and clevis 432 pinned to rope 420 so dog 430 will tilt down and up on each end between wheels 425. Dogs 430 can be flexibly connected from both ends by short lengths of rope to rope 420 to hold the dog from excess flopping when passing over end pulleys and to help align it for engaging between channels 428 which have webbs flaired out on ends to receive wheels 425 in either direction of travel of the rope 420, or rails 428 can be run around end of pulleys 422 to guide wheels 425 all the way. Dogs 430 tilt down on whichever end is forward on lower run when rope 420 is pulled, because it is attached to the rope above its pivot, and reverses when direction of rope is reversed, and is free to recess to latch objects past.

Opposite-facing spring-lifted latches 344 are secured on top each protrusion 47 above center of each end of carrier. Latches 344 slope down from end of carrier for dogs 430 to push carrier from behind only and latch past front end. With a dog 430 every carrier length plus clearance the dogs space carriers apart as they are pushed along track ST' and enable tractors 328, which can move on track ST' faster than the ropeway, to load the ropeway with solid line of carriers even as the ropeway operates, enabling a short ropehaul to be fed additional carriers while servicing a long train for many transfers while moving by the transfer dip.

A dip stop 330, FIG. 58, is mounted between rails of track ST' at each end of each dip DD to engage forward latch 344 on first carrier to hold carriers from the dip until coupled by car in train. Each stop 330 is a latch pivoted on transverse pin 444 at dip end and sloped down and back from the dip to stop carrier or container at head of dip. The latch is lifted by solenoid or air cylinder 446 just before the carrier thereat is coupled to let carrier enter dip when coupled by car. Latch 330 and lift cylinder 446 are mounted in a frame 448 supported on four outboard flanged wheels 450 to roll along and between channel rails 452 central and parallel above track ST' and is cushioned by spring 454 between back of frame 448 and a cross member 32 between columns 34 supporting track ST' to cushion stop 330 when struck by carriers approaching dip.

Each ropehaul RH is driven by two reversable spur-gear motors 458, one connected to each shaft 424 to drive pulleys 422 to feed line of carriers to or from dip. Carriers 316P and 316F fed to dip are respectively engaged at head of the line one at a time by berth on cars 14P or 14F extending couplings 234F or 234P for a transfer run. The cars extend coupling only to engage first carrier in line, so carriers must be advanced as fast as cars take them away. Ropes 420 are driven at speed faster than train and are reversed for train from opposite direction and clear carriers which have completed a dip run from accumulating at after end of dip and preferably feed them past first switch 324 wherebeyond tractor 328 can get behind to push them into classification tracks from either end of the station.

STATION CABLEHAUL CONTROLS

Referring to FIG. 57, the ropehauls and stop controls for the two station dips DD include contact rails 461L and 462L at respectively head of first and second dips on each side of track T for train from left and rails 461R and 462R at heads of first and second dips on each side of track T for train from right and contact ramp rail 464 along track T along each dip run and for coupling distance beyond each end along where cars extend couplings and engage carriers on track ST'. When train 12PF approaches station, about half mile ahead (formerly ten miles) a shoe 466 on at least one car or locomotive of train 12PF engages a contact rail 468 connecting power from positive of its battery 470 to the rail 468, coil of reset relay 472 to ground, opening circuit to drop relay TL or TR for train from opposite approach. Next shoe 466 leaves rail 468 and engages a contact rail 473 connecting positive of battery 470 to rail 473 connected to top coil of stick relay TL or TR depending if train is from left or right, lifting relay TL or TR, which is held by circuit from positive of battery 474 at station, line 476, back contacts of reset relay 472 opened after train has passed station, top front contacts and hold coil of relay TL or TR at near end of station to ground of battery 474. Relay TL or TR connects power from negative of battery 474 through its bottom front contacts, resistance 478, rectifier 480 to contact ramp rail 464 along first transfer dip and berth length beyond each end and connects power from positive of battery 474 through second from top front contacts, resistance 482, rectifier 484 to the contact rail 464 along second transfer run according to direction of train's approach.

Each car 14P and 14F in train 12PF has circuits as shown for a two berth car 14F to control extension of vertical couplings to extend between second and first carrier in line at stop 330 for a dip transfer which the berth on the car calls for and to recess stop 330. Shoe 486 on each car 14F and 14P engages negative rail 464 along first dip run completing a circuit on the car from shoe 486, rectifier 487, contacts on electrical plug 488 for each berth to container in berth, contacts in route reader 490 (as in FIG. 21 of my U.S. Pat. No. 3,483,829) or other control means to complete circuit when container is to be removed, contacts to plug 488, cam switch 492 lifted by rail 464 along where vertical coupling for that berth can be lifted, line to shoe 493 for each carrier berth on the car and engaging rail 461L or s61R at head of first dips, solenoid of valve 494 for that berth to ground, connecting pressure from AIR through valve 494 to head ends of coupling lift cylinders 362 for berth calling for removal of container. When shoe 486 engages positive rail 464 along second dip run a circuit is completed on the car from shoe 486, rectifier 496, line 497 branching to normally closed limit switch 498 opened by container in each berth, normally opened contacts of cam switch 492 for that berth, line to shoe 493 for that carrier coupling berth, solenoid of valve 494 for that berth, to ground, to extend vertical couplings of that berth to engage loaded carrier at head of second transfer run to load container into the berth on the car as it moves along under the dip. Stops 330 at head of dips ahead of carriers coupled are lifted by a live shoe 493 engaging rails 461L and 462L at respectively head of first and second dips for train from left or 461R and 462R for train from right. Rails 461L, 462L, 461R and 462R are connected to lift solenoids of stops 330 at respectively head of first and second dips for trains from left and right. Shoe 493 for first and second berths are spaced to engage rail 461L in succession at head of first dip for train from left to lift stop 330 for carrier coupled to pass by lifted stop; likewise engaging rails 462L at second dip or rails 461R and 462R for train from right. Stops for reverse direction are passed by carrier lifting them. This transfer works in either direction of traffic with empty carriers at head of first dip and full carriers at head of second dip.

Stick relay or TR also closes a circuit from positive of battery 474, line 476, third down front contacts of relay TL' or TR' according to direction of train, line 499L or 499R to coil of relay TL' or TR' respectively to ground in parallel from lines 499L, a rectifier 500, normally closed contacts of limit switch 502L opened when carrier (empty) is at stop at head of first transfer run to shunt fields of ropehaul motors 458 and coils of starters 504 for these motors to ground, closing starter contacts through resistance thereof, front contacts of relay TL', armature of motor 458 for the ropehaul for feeding first dip, to ground, and from line 499L, a rectifier 500, normally closed contacts of limit switch 502R opened by carrier at head of second dip, starter coil for rope haul for second dip similarly connecting motors of that rope haul to bring carriers with containers to line up at second dip stop, and from lines 499L and 499R each through a rectifier 500 to starter for respectively ropehauls at far ends of first and second dips to run steady to clear away carriers from ends of the dip after completion of a transfer run.

The stop 330 at head of each dip when ahead of carrier coupled ahead of the dip is lifted by a live shoe 493 engaging rails 461L and 462L connected to solenoid to release stop 330 at heads of first and second dips respectively for train from left and engage rail 461R and 462R connected to release stops 330 at heads of first and second dips for train from right.

CARRIER TRUCKS

Carriers 316P and 316F are preferably suspended from trucks 510, FIGS. 61–64, to replace wheel assemblies on carriers for bearing heavy loads and to improve riding and tracking on curves and switches, FIG. 65. Truck 510 has two end trolley sides 512 and one middle trolley side 514 of hollow box construction of welded steel plates or hollow cast. Each trolley side is pinned on a shaft, tube 516, transverse across the bottom through two loops 517 of knuckle 518 separating the three trolley sides and having central depending column 519 mounted to swivel horizontally on top of each end of frame 320 of carrier. Two outboard wheels 44 each mounted on a shaft 520 extending from outer side face of outer trolley sides and two wheels 46 mounted on one side of central trolley side are all gaged to run on three rails of track ST' or ST. Trucks 510 at opposite ends of the carrier are reversed to support either end of carrier out over a dip on track rails 40 and 42. Trolleys are aligned and connected to tube 516 to rotate in knuckle 518 fore and aft ends up and down on inclines of track ST' or as ST. As optional feature springs 522 are pocketed one each side of tube 516 at each end of knuckle joint 518 between tabs 528 on outer trolley sides and tabs 529 on swivel knuckle 518 hold the trolley upright to re-engage on track ST. The frame of the carrier preferably is sloped up on bottom at swivel knuckle and supported on pin through the knuckle to bias the truck parallel to frame 320 yet enable truck to turn on curves.

LADDER TRACKS

The station classification tracks STC are preferably closely spaced, FIGS. 65 and 66, to better utilize storage space and reduce size of supporting structure with one row of columns between adjacent tracks STC. Ladder track branches branch in two so that the station tracks can be spaced close along side each other and so switches 324 are separated from each other. Switches 324 have vertically moveable rails 30M supported to counter balance each other and guide on vertical rods 528 secured to top of fixed channels 30 through holes in supporting tabs 530 secured extending from top of moveable channel rails 30M over fixed channels 30. The moveable switch channel rails of each switch are preferably suspended from and connected by a rope 532 or roller chain at each end to run up and down over sheaves 534 or sprockets supported from beams 32 to rotate in vertical plane over each end of each moveable channel 30M. The switch is actuated by a teeter lever 536 pivoted at center and bearing down at opposite ends on top of oppositely moveable switch channels 30M and operated by a two-way air cylinder 538 connected between a cross member 32 and lever 536 to actuate the switch rails 30M oppositely up and down to throw the switch. The arrangement of the switches 324 in the ladder tracks between tracks STS and ST', FIG. 41, is same as in FIGS. 65 and 66.

GANTRY

Each gantry G has two channels 30' turned legs in connected on top by cross members 540, one at each end to form track STG supported on telescoping columns 542 at each corner and secured to bottom of cross-member 540 and to outsides of channels 30' to position track ST'. Columns 542 are each made up from two sections of pipe, FIG. 69, the lower section slip fitting into the upper and having a large nut 546 secured from turning to top of inner pipe. A threaded hollow shaft 548 runs through each nut 546 and out top of the outer pipe where miter gears 550 and shafting 551 connect each threaded shaft to turn together to raise and lower the gantry legs equally together. Gearmotor GH is connected to drive shafts 548 to lift and lower track STG to set down and pick up containers on carrier positioned on track STG, which is lifted to clear over containers in storage. Two double-flanged wheels 554 are mounted between legs of U-channel 556 extending legs down between bottoms of lower pipe legs on each end of the gantry to run on track GT. Wheels 554 have a beveled gear 558 integral on inner face of a flange engaged by a beveled gear 560 on vertical shaft 562 run through hollow shaft 548 and connected above shaft 548 by beveled gears 564 and shafting 566 to reversible gearmotor GM to drive the gantry wheels 554 in synchronism.

The gantry has a chain conveyor 568, FIGS. 70 and 71, with five dogs 570 equally spaced on endless chain 572 for engaging between upstanding pins 574 one each end of each central bracket extension 47 or on trolley 514 to position and move the carriers on and off the gantry. Conveyor 568 has channel rails 576 which guide chain 572 between sprockets 578 one at each end of gantry and mounted under bracket 580 extending out from side of horizontal end members 540. One sprocket 578 is secured on end of shaft of gearmotor GC mounted on top of the bracket 580 at right. The other sprocket 578 is mounted on shaft 582 through a slot in the bracket 580 at left and supported in takeup bearing housing 584 mounted onto top of the bracket.

The carrier is secured in position on track STG of the gantry by locking conveyor 568 whose dogs 570 interlock between pins 574 on the carrier. The conveyor 568 is held by a brake or stop 586 engaging a dog 570 on back side of conveyor. Stop 586 has solenoid to release from the dog and closes contacts 592 when released and contacts 594 when engaged with a dog, but the contacts are opened when the stop is extended before locking a dog. The conveyor is moved two dog lengths, one carrier spacing length, in either direction according whether gantry is loading or unloading to engage a waiting carrier at end of track ST' and move it onto the gantry and move preceeding carrier off the other end of the gantry. The waiting carrier is held at end of track ST' by engaging the rod of a stop solenoid 596, one being mounted on side of channel 30 at each end of track ST'.

The gantry is secured to align ends of track ST' before conveyor 568 can operate. Solenoid operated pins 598 mounted to outside or under channels 30 at ends of track ST' each engage in a tapered hole in a block 600 secured on gantry frame to hold gantry in alignment for movement of carriers on and off. Pins 595 have contacts 602 connected by the solenoid when inserted in tapered hole in block 600 to depth insuring that the gantry is engaged. Circuits are completed from positive of battery 474 at station, FIG. 70, limit switch 604 closed when gantry aligns track ST', normally closed contacts of relay 606 later opened to release gantry interlocks with track ST', line 608, solinoid for pin 598 to ground in parallel from line 608 with contacts 602 of the solenoid closed only when its pin is engaged in block 600 on gantry, coil of left-hand locating pin 598 to ground in parallel with contacts 602 of that solenoid closed only when engaging in gantry, solenoid of left-hand carrier stop 596 to ground, in parallel with contacts of the stop closed when stop is pulled out, solenoid of right-hand carrier stop to ground in parallel with contacts 610 thereon closed when the stop is released, contact "*a*" to gantry, annular segment 612, wiper 613 and inner annular segment 614 of ratchet stepper 616, solenoid release for conveyor stop 586 to ground, retracting stop 586, closing contacts 618 to start motor GC in direction determined by reverse relay 620, FIG. 72. Dogs 570 close limit switches 621 and 622 on each side of stop 586 as conveyor 568 moves and steps ratchet 616 four times before conveyor 568 is shutoff when wiper 612 leaves segment 614. Then the conveyor coasts until next dog is caught in stop 586. Stepper 616 stepped wiper 612 to connect segment 612 to contact 624 on fourth step, closing circuit to lift relay 606, releasing pins 598 and inserting carrier stops 596. When pin 598 at right is retracted a circuit is completed from positive of battery 474, contacts 626 of locating pin 598, line 627, bottom contacts of conveyor stop 586, reset coil of stepper 616 which is then reset by its spring. Then control circuit for motor GM is closed from line 627, normally closed contacts of solenoids' pins 598 closed when gantry is released, and normally opened contacts of solenoid stops 596 closed when inserted to stop carriers from rolling off track ST', in series, contact "*b*" to starter for motor GM on gantry to run in direction set by relay 630.

GANTRY CONTROLS

Two storage gantries are shown in FIG. 41 and controls therefore shown in FIG. 72 to speed loading and unloading. The gantry controls are designed to put containers in ground storage and retrieve them automatically. One gantry travels between station tracks and storage spots at left, the other travels between station tracks and storage spots at right. Containers for train are preloaded on carriers by the gantries and moved onto the station track ST' and switched to classification track for the train so the carriers are ready loaded for train. Gantry aligns carrier over container in storage on ground, pedestals or on trailer spotted along the gantry run, lowers, engages hooks under the container, releases hold downs on the storage spots or trailer and lifts the container on the carrier over other containers along the storage run and aligns its track STG with a track ST' or STS. The gantry pushes off the loaded carrier and takes on next empty carrier. Next farther container calling for gantry causes gantry to come etc. until containers in storage between rails of the gantry run GT are loaded on carriers for a train. Gantry for opposite end of gantry run runs in reverse direction to load or unload carriers from either interchange with track ST'. The first gantry near tracks ST' prevents the other gantry from approaching these tracks but lets the other gantry go to its storage end to pick up or set down a container or wait for clear track to move to align a track ST'. Or each gantry could bridge only the gap in track ST' at their end by eliminating or switching out the overlap of control lines for each.

Along the gantry track GT is run a power line 634, two control lines 636L and 636R for respectively gantry on left and right, and load-unload line 638. Each control line is divided into a stop segment 640 and 641 at respectively each storage stop and each station track alignment stop and an alignment segment 642 on right and left of each storage stop and a segment 644 between station track stops. Each storage stop 640 is controlled by a relay 646 and each track ST' stop by a relay 648 for each control line. The control line 636L for gantry at left extends from station tracks ST' to left, and line 636R for gantry at right extends from these station stops to right. Each stop 640 and 641 and the control line segments on each side are connected through back contacts of their stop relay 646 or 648 together to connect the control line segments when the stop is not set. Each stop is grounded through front contacts of the relay 646 or 648 on each side connected through front contacts of the stop relay to respectively line 650 and 651 to positive and negative of battery 474. Each segment 642 is connected through bottom back contacts of its storage stop relay and a rectifier 654 to pass current from positive of battery 474 to adjacent segment 642 of next further out storage stop from the alignment stops at track ST'.

The gantries can be controlled to load carriers for a particular train by closing switch 656 a number of times to represent the train's route preferably an hour or more before train time to give ample time for gantries to load carriers for that train. Switch 656 completed a circuit from positive of battery 474, front contacts of load-unload switch or relay 658 closed to line 638 along gantry run, switch 656, line 660 along gantry run to contact of plug 662 at each storage spot, ratchet stepper 664 on each route reader 665 on each container is storage to ground to step number of times switch 656 is closed, to position reader to complete reading circuit from line 638 to each storage spot, rectifier 668, contacts of plug 662 to receptical on a container on the storage berth, contacts through punched hole in routing card in reader 665 on container routed for that train, line 670 to coil of stop relay 646 for that storage spot to ground. The stop relay 646 so lifted connects its control line stop 640 to ground and segments 642 to left and right respectively to positive and negative of battery 474. The gantry has relays 672 and 673 connected reversely through rectifiers 674 and 675 across shoe 676 on control line 636L or 636R and ground to determine direction of travel according to polarity of the control line, and a grounded control line stops the gantry with controls same as for crane motor CM in FIG. 99 of my U.S. Pat. No. 3,483,829. The gantry moves to nearest stop set along its runway.

The gantry must be at a set load-unload stop 640 before gantry hoist GH can operate. Then hoist lowers and lifts with the same controls whether loading or unloading. Relay 678 is lifted to start hoist down. Coil of relay 678 is connected between shoe 679 and ground and lifts when it engages a live contact 680 at a set stop. Armature of hoist motor GH is connected reversely through contacts of reverse stick relay 682. Relay 682 is lifted by circuit from line 660, shoe 684, line 685, limit switch 686 closed by gantry reaching bottom of travel, resistance 687, top coil of relay 682 to ground to reverse motor GH to start hoist up and is held so hoist runs up to top limit by circuit from line 685, limit switch 688 opened when hoist reaches top, bottom front contacts and bottom coil of relay 682 to ground.

Since carrier loading can be completed ahead of train's signal the train need not signal its route number until about a mile from the station, in time for carriers to be positioned at heads of the transfer runs. A train from left or right shifts relay TLR to left or right respectively when it's locomotive or a forward car therein engages shoe 690 on rail 691 to signal the train's route number with control RN, FIG. 72 as in FIG. 26 of my U.S. Pat. No. 3,483,829. When the train signals its route the signal steps ratchet switch 692 to complete circuit to light a lamp 694 and/or close switch or switches 324 to classification track with carriers loaded for the train. Switch 324 cannot be reversed with weight of vehicle thereon and blocks vehicle therefrom during switching.

If each interchange of gantry with track ST' is used to load or unload carriers for a particular loop of tracks ST' the two gantries can work loading carriers on the loop farthest from the train and later both unload carriers from the first loop which have containers taken from the train. For this purpose train 12FP approaching the station throws relay TLR to left or right according to whether it is approaching from left or right respectively and lifts loading relay 658 until after the train passes the station. The circuit is from positive of battery 466 on train, shoe 695, rail 696 about a mile to left or right of station and connected to left and right coil of relay TLR respectively to ground in parallel with bottom and top coils of realy 658.

Each carrier on gantry is checked to be empty for loading by circuit from positive of battery 474, front contacts of load-unload relay 658, line 638, shoe 700 and contact line 701 on gantry, shoe 702 on carrier, normally closed contacts of limit switch 704 and rectifier 705 to pass this current in parallel with normally open contacts of limit switch 704 and rectifier 707 to pass current of opposite polarity to shoe 708 on carrier engaging line 709 parallel line 701 along track STG to shoe 710 on the gantry on the left engaging contact rail 711L along gantry run for gantry on left, line 712L, coil of relay 714L to ground to lift the relay 714L to drop station stops so gantry on left can leave for its nearest storage stop set. Shoe 710 for gantry on right engages rail 711R along its run connected to coil of relay 714R to ground to lift relay 714R to drop station stops for gantry on right. Only one of the four station stop relays 648 is set (lifted) at a time, by circuit from positive of battery 474, line 716, back contacts of relay 714L or 714R, left and right-hand contacts of relay TLR respectively to lines 717L and 718L or 717R and 718R, from line 717L, coil of stop relay 648 for station stop at left in series with back contacts of a stick relay 721 to ground for setting station track stop at left for left gantry, and from line 718L, coil of stop relay 648 for station stop at right, each in series with back contacts of a stick relay 721 to ground for setting station track stop at right for gantry at left, and from lines 717R and 718R, separately through back contacts of relay 722 respectively to coils of relays 648 for station track stops at left and right for gantry on right. Relay 722 is lifted by circuits from positive of battery 474, front contacts of relay 658 to line 638 for loading or from negative of battery 474, back contacts of relay 658 to line 658 for unloading, shoe 700 connected to shoe 724 on gantry for left shown, rail 725 and line to coil of relay 722 to ground. Relay 722 is latched up until released by shoe 724 engaging rail 727 farther outward from the station stops and just beyond rail 725. Likewise a shoe 724 on gantry on right would connect power to rails 730 and 732 in succession in leaving for storage spots to drop relay 721 to pick up first relay 648 from left at either station track interchange set by relay TLR so gantry at left can set its station track stop when relay 714L drops.

For unloading carriers the negative of battery 474 is connected through back contacts of load-unload relay 658 to line 638 engaged by shoe 700 on the gantry, contact line 701, shoe 702 on carrier on gantry, normally open contacts of limit switch 704 closed by container on carrier, rectifier 707, shoe 708 on carrier engaging contact line 709 on gantry, shoe 710 of gantry engaging line 711L or 711R, line 712L or 712R respectively to coil of relay 714L or 714R to ground to drop relay 648 holding the gantry so gantry when unlocked can move to nearest empty storage spot set. The empty spots are set by circuit from line 638 (now negative), line to each storage spot, rectifier 734 and normally closed contacts of limit switch 736 closed only when spot is empty to line 670 and coil of relay 646 for that storage spot, to ground.

When a carrier for loading or unloading is moved onto the gantry, relay 658 being lifted to load or dropped to unload, relay 714 is lifted by circuit through rectifier 705 or 707 respectively on the empty or loaded carrier, dropping the station track stop which was lifted. Then when the carrier is locked on gantry and gantry unlocked from track ST' and ends of track ST' stopped, gantry runs to its nearest storage stop set by positive current through rectifier 662 to load or negative current through rectifier 734 to unload the carrier. These rectifiers block current to unset the storage stops after the gantry has loaded or unloaded the carrier respectively, but gantry is held until its hoist is raised back up before returning to station stop set by dropping of relay 714L or 714R by rectifiers 705 and 707 on the carrier after being loaded or unloaded at the storage stop.

If each gantry is to serve a different interchange with track ST', instead of both, the center two relays 648 would be omitted or disconnected and the overlapping sections of control line disconnected by opening switches 738 across section insulators. If only left-hand interchange is to be used the left-hand two relays 648 would be disconnected and lines 718L and 718R and coil of relay TLR disconnected with relay TLR in position shown.

Since each carrier only holds one container all carriers aligned at first transfer run for train are empty and all at head of second run have a container for the train thus eliminating selective preloading of carriers according to requirements of cars in train, eliminating transfer reservation circuits and call lines to carriers to specify loading and greatly simplifying the system over my preceeding designs and enabling containers to be left on the inexpensive carriers to wait for their train. The gantry controls are designed for the double loop station of FIG. 72 where each loop has a transfer run over track T for high terminal capacity or as part of station FIG. 41 for high interchange capacity between trains on different routes.

GAGE-CHANGING DOUBLE-DIP TRACK AND VEHICLES

Referring to FIGS. 73–80 for another variation of level dip transfer, where carriers 316F′ and 316P′ have frames 320 and outboard V-grooved wheels 44V each mounted on end of a sleave 740 with trunion ring 742 mounted thereon to slide shaft 740 in and out on end of shaft 744 secured in bracket 745 at center to top of frame 320 transversely to the carrier one shaft 744 along each end of carrier. Along each side on top of frame 320 a channel 746 is mounted at center on vertical pin 748 through both legs of the channel. The pins are secured directly or bracketed to frame 320 central one on each side. The webb of each channel 746 is cut away at each end, FIGS. 78 and 79, and legs slotted to engage top and bottom trunnion pins on ring 742 at that end to control gage of wheels 44V at either end of frame with wheels 44V at the other end. Bracket 745 fills space between sleaves 740 to set inner limit to the narrow gage for wheels 44V. The wheels 44V at opposite end are then set to the wide gage just beyond rails of narrow gage.

Track ST″ has V-rails 30N with angle turned vertex up set to narrow gage outboard along inner slopes and similar V-rails 30W set just beyond rails 30N to wider gage along outer slopes of each dip. Forward wheels 44V ride on wide gage rails 30W going down the dip, and rear wheels 44V ride on narrow gage rails 30N going down the dip. Along bottom of the dip front wheels are shifted to narrow gage before going up slope as rear wheels are changed to wide gage by a stationary switch 750 having a flat plate or rail base 751, a baffle plate 752 on each rail base to shift arms 746 from rear wheels to shift front wheels to narrow gage, and preferably an edge plate along the base rail to help guide the wheels. The track ST″ when in form of a loop or loops as track ST′ has a gage shifting switch 750 in each rail on the upper level, so the front wheels of the carrier are shifted out to wide gage before returning to head of the dip after passing around the loop.

The passenger and freight cars in the train 12PF′, FIG. 74, can be or are the same as in FIG. 43. The passenger car and carrier of FIG. 74 shows a variation having two container berths which arrangement is equally applicable to the dip of FIG. 43 and vice versa.

The station track and containers of FIGS. 1–8 and 16 can be replaced by the type of track and containers 16′ shown in FIGS. 76–77 with the gage shift arms 746 for the outboard container wheels 44V to shift the wheels on the containers while moving at low speed in the station. This station can have the other features of FIGS. 1–40. The station track of FIGS. 76–77 is of the same crossection construction as the track of FIGS. 73–75 and switches 750 the same except turned around so flats 752 are on outside, since the wheels 44V are reversed along the top of the dip oppositely to along bottom. Track ST‴ is preferably omitted along bottom of the dip between stations and wheels 44V are shifted by any suitable means such as baffles 752′ so wheels 44V at front are at narrow gage before lift-out slope to next station. Arms 746 mounted on top of the containers or carriers should operate stiff enough to keep from changing gage except at a baffel 752 or 752′.

PROPULSION RAIL

A preferred method of moving these carriers and containers, which are not self-propelled, is by propulsion rails placed flush with rail and to gage of track ST or ST′. A variety of propulsion rails are shown in FIGS. 81–92 which can accelerate the carrier to safe coupling speed ahead of alignment with the spot into which they are to go for transfer and slow them when removed from the cars to stop at the stations, move them about the station track for loading and unloading in preparation for transfer with a train or other vehicle, and retard and move them in the classification yard.

One form of propulsion rail is shown in FIGS. 81–84 wherein starting and stopping sections of tracks ST and ST′ have air lift sections PR comprising a base rail of square bar 760 with trough 762 milled down in center along top and a line of round holes 764 milled in below from trough, a key 766 along each side wall of trough, and rectangular rail-head blocks 768 each having a cylinderical piston bottom projection for slipping into each hole 764 and a flat milled on each side of the cylinder to slide up and down on key 766. Adjacent piston holes 764 are connected by two air holes 770 sloped from side of hole 764 down and in to bottom of adjacent hole 764. Key 766 along each side in keyway secures blocks to limit lift so blocks will not blow up out of holes 764 but lift in succession when sufficient air pressure is inserted under at port 772 to bottom of hole 764 at either end of base 760 with port at opposite end valved or blocked off. Each piston hole has a port 772 at bottom. Each port 772 except end ports are connected through a check valve 774 to relieve to line 775 to first port at right to exhaust after input pressure is shut off.

Air pressure is connected to line 775 from any suitable source of low pressure A and selectable high pressure B through valve 778, so blocks 768 will be lifted by pressure A only up to first wheel 44 of vehicle until time to start; then valve 778 is opened to B to increase pressure to start and accelerate vehicle by successive blocks 768 lifting behine wheel 44 faster as vehicle is accelerated thereby. Adjacent sections of rail 760 are connected by tubing to pass air on to next section of rail 760 after last block is lifted in the preceeding section.

When a rail block 768 is lifted by air pressure below its cylinder it uncovers port hole 770 from side of cylinder to bottom of next cylinder for either direction of travel which lifts the next cylinder of the block etc. to lift blocks 768 in succession from either end of rail 760 to push wheel 44 in direction away from pressured end. The rail can be used as a vehicle brake by connecting air pressure to lift blocks from far end ahead of vehicle so when the first wheel 44 rolls thereon from near end it forces the blocks down driving the air through relief valve 779 at far end slowing the vehicle down. If air pressure is too high the wheel may ride up on lifted blocks 768 but will settle down as the pressure is relieved in passing air back behind the wheel.

Referring to FIGS. 85 and 86 V-rail heads 768V with vertex up can replace heads 768 for V-grooved wheels.

A cheaper propulsion rail 760′ is shown in FIGS. 87 and 88 where blocks 768′ are rectangular with central tapered cut 780 milled on flat bottom and inserted in channel base rail 760'. Key pins 766' limit upward movement of blocks 768'. Neoprene seals 782 block air from bottom most edge of block to next block until the block is lifted by air entering in the tapered cut to lift the blocks in succession from one end to push a wheel 44, or after being lifted to retard a wheel entering an inflated section of rail.

Further simplification of construction of wave rail to PR", FIGS. 89 and 90, has a base rail 760" of upturned formed channel with legs bent in, an inflatable neoprene bag 786 laid in channel 760" along length thereon, a flexible steel strip 788 with a continuous line of steel blocks 768" secured on top of the strip laid along on top of bag 786 in channel 760" with blocks 768" extending above the channel to form a running rail. Strip 788 extends under the inward turned edges of channel 760" to limit upward movement of the running rail when bag 786 is inflated at port 772" at either end to move or ratard a wheel on the rail. The weight on wheel 44 on rail PR" completely pinches off air in bag 786 from passing beyond the wheel. The bag and rail can be full length required to accelerate the vehicle. Air can be introduced on both ends and sides of a vehicle before acceleration and then pressured on one end and blown out the other end of rails 740" through metering valves to accurately control acceleration.

A lever type propelling rail, FIGS. 91 and 92, is designed for moving or starting heavier carriers or containers and has a channel base 760''', two angles 790 turned one leg up and one out and welded along top of each leg of channel 760''', a line of levers 792 of channel construction turned legs down on top over upturned legs of angles 790 and each secured at left end by a pin 794 through upturned legs of angles and abuting to form a running rail, a cylinder 796 for lifting the right-hand end of each lever 792 and mounted in channel 760''' rod up connected by links and pins 798 to right-hand end of the lever 792 above. Inlet 772''' is at right to head end of cylinder 796 at that end. Each cylinder 796 is ported at bottom to side. All but first cylinder at right are connected each through a check valve 774 to inlet line 775 to port of first cylinder 796 to exhaust when input pressure is relieved through valve 800. A high port 802 is opened to pressure in each cylinder lifted. This port is connected to head end of next cylinder to left to pass pressure on to lift next cylinder etc. The lifting of cylinders 796 lift levers 792 in succession from right to left to form incline to start a wheel 44 thereon rolling to left and follow it up to keep it rolling. This is preferably operated by hydraulic fluid for slow operation of the levers to give the wheel time to roll onto the next lever before it starts to lift. Fluid is connected from tank 803 through pump 804, line 805 to valve 800 at right to inlet port of first section of rail 760'''. Values 800 are two-position pilot-piston operated except the valve at right has a solenoid operator to open to start pressure lifting the levers in succession from right to left when the valve 800 is shifted to position shown. When the last piston of a section is lifted, pressure is connected from rod end of that cylinder to outlet port to lines 808 to right-hand pilot cylinder of valve 800 for next section of rail 760''' to open the valve 800 for pressure from pump 804 to enter inlet 772''' for that section to continue the lifting of levers 792 in succession to left, and line 808 is also run to left-hand pilot cylinder of the valve 800 for first section of rail 760''' at right to force spool of that valve to right cutting off pressure and opening exhaust to drop cylinders of first section etc. All cylinders except first exhaust through the check valves 774 so the section of rail is fully exhausted together.

Wheels 44 and 46 can be mounted on a frame 320 detachably secured to a container as is carrier 316F or 316P to engage rails of station track ST to be put on and taken off trains. Container carriers having wheels arranged as on the container for the respective tracks of FIGS. 1–8, 16, 32–40 and 76–77 become as part of the container when secured thereto to travel with the train, since they horizontally interfit with the car in the train. The carrier is released from the container at a station when set down as on a trailer by the gantry or other means so that the container will have road clearance for underpasses and lower center of gravity by leaving the overhead wheels behind. Of course these wheel frames could be bolted on top of the container for rail shipment, instead of just being hooked on, and removed for highway and ship transfer. The station track ST can be branched between the decelerating and accelerating runs or between lift-off and set-on ends of the station track to align storage gantries and to connect classification tracks for storing the containers.

Having thus described this invention for container transfer with variations and improved components, I do not wish to be limited by the means, arrangements or specific applications disclosed but contemplate to cover all features within the spirit and scope of this invention as defined by the following claims.

I claim as my invention:

1. An overhead container transfer system for unloading and loading transportation vehicles passing a station, including a lower guideway having at least one transportation vehicle thereon, an overhead track run over said guideway for vertical transfer including a slope down and an opposite slope up, at least two transfer containers, a said container being on said vehicle when approaching said station track to meet said slope up from bottom, carrier means for engaging and suspending said containers to travel said overhead track and up said slope, vertical coupling means on said vehicle for pushing said container up said slope up above said vehicle, said overhead track being sloped up to height to carry container above the vehicle and any load thereon, conveying means above said vehicle and along said station track to receive and move the container lifted out to stop for transfer at the station, and accelerating means for starting and accelerating the second said container on said station track including a dip in said track to lower the outgoing container to coupling height and reach coupling speed ahead of coupling alignment with the vehicle to be set on the vehicle, said coupling means on the vehicle engaging said container at safe coupling speed and aligning container over spot to set on vehicle and hold this alignment while pushing container to and along where said track is sloped down to set container on the vehicle.

2. A system as in claim 1 wherein said slopes each have two rails on each side for one end and at least one rail spaced at wheel base length for suspending other end of said container substantially level.

3. A system as in claim 1, said conveying means being a belt conveyor, and means for driving it at speed of vehicle as vehicle approaches and means for decelerating the conveyor when container is set thereon to stop container at unloading-loading spot.

4. A system as in claim 1, said accelerating means being a ropehaul above container on station track and having dog for pushing container and snubber for preventing container from bounding ahead so vehicle can engage the container from below, and means for timing start of ropehaul so container reaches coupling speed just ahead of alignment for coupling with the vehicle.

5. In a system as in claim 1, said vehicle comprising at least one railway car having a top with hole therein for receiving and dispatching said containers, said coupling means being a container catepult including a track along length of and on top of said top, a container coupling carriage on said catepult track for latching a container therein horizontally, catepult means for cushioning and aligning a container caught in said carriage to align with said opening for transfer of container into said car, and control means for the catepult to move said carriage to front of said car when said carriage and a spot for a container through said opening are empty to position carriage at front for maximum cushioning travel when receiving a container.

6. In a system as in claim 1, a safety stop track at end of station track normally connected thereto by hinged descending slope rails of the station track counterbalanced to be lifted to align safety track for stopping container, latch means to normally latch said descending slope rails up, means on vehicle to detect container on station truck when aligned and coupled for transfer onto vehicle ahead of the transfer-in dip for controlling said latch to release for transfer of the container to empty spot on vehicle.

7. A system as in claim 1, said overhead track having rails spaced at two gages, one for front and one for rear of said carrier means and switches hinged to swing vertically in inner rails at top of slope so inner wheels and outer wheels take inner and outer rails respectively and outer wheels pass inner rails by wheels controlling the switches to maintain the container substantially level on the slopes.

8. In a system as in claim 1, means for detachably securing said carrier means above and to said containers to travel with container on said vehicle but removeable for container to be carried separate.

9. In a system as in claim 8, said carrier means having frame having hooks for engaging a container when set thereon and for releasing a container when set down the same vertical travel thereon, vertical coupling on the train, said frame horizontally interlocking with the vertical coupling on the vehicle to prevent shifting out of alignment on the vehicle.

10. A system as in claim 1, said carrier means being a carrier for a load and having a frame with hooks for automatically engaging at least one load when lowered empty on the load and for releasing the load when the load is set down and the hook lowered enough to clear from under the load.

11. A container transfer system as in claim 1, said overhead track having said transfer slopes that maintain a container on the carrier means thereon substantially level, the slopes comprising a track for each end of the carrier means, the track on inner face of the slope being wide gage outboard the container, the track at outer or front face of the slope being above the container, this latter track is provided for the slopes off center equally and oppositely at opposite sloping slopes to carry either end of said carrier means outward over slope.

12. A system as in claim 11, said carrier means being the top portion of said container, said track being open ended at bottom of transfer slopes for container to release, the track on inner face of slope extending substantially horizontally out from the bottom of transfer slope to align the container ahead of the slope up.

13. A system as in claim 11, carrier means for said track being container carriers and automatic hooks thereon for engaging, suspending and releasing the container therefrom.

14. A container transfer system as in claim 1, said way being a railroad track, said vehicles being trains, said carrier means being container carriers suspended therefrom, said station track including classification tracks for storage of said containers on said carriers for particular trains, ladder tracks connecting ends of said classification tracks, two transfer runs of said station track connected to said ladder tracks and run over each railway track to be served, each run in parallel, both running in succession for a transfer run over the railway track, each transfer run having a double dip down and up for substantially level transfer of containers to and from trains passing the station, empty carriers on said station track ahead of said first dip and carriers each having container for train and waiting on station track ahead of second dip according to train direction, means for selectively coupling successive carriers to cars in train passing under for transfer run according to transfer requirements of the cars, means for moving the carriers to and from the transfer dip runs, hook means on said carriers to engage container when lowered thereto by either said dip and to release container when set down on car by either said dip the same vertical movement for engaging or releasing container, and means for loading and unloading the carriers of containers at the station for local delivery and storage.

15. A system as in claim 14, said means for loading and unloading the carriers being a traveling gantry having trackage aligning said station track for receiving and delivering carriers thereon and hoisting means to lift and lower said trackage on the gantry to pick up and set down a container by means of a carrier on the trackage of the gantry, and means for moving carriers off and on the gantry when aligning the station track and for positioning on the gantry.

16. A system as in claim 14, said means for moving including propulsion rails in said station track system to accelerate and retard said carriers.

17. A system as in claim 1, said guideway being a railway track, said transportation vehicle being a railway car.

18. In a system as in claim 1, said vehicle having a berth for each of a plurality of containers, said vertical coupling means being a coupling carriage on said vehicle for catching a said container along said station track and aligning it with a berth before said slope down to lower the container into the empty berth.

19. A system as in claim 1, said vehicle having lift frame to receive and hold container and lower on vehicle to clear under said station track, and controls to lift said frame selectively ahead of said slope up to engage the container thereon with said station track for transfer out.

20. In a system as in claim 1, said carrier means having outboard wheels above each end of the container and an inboard wheel offset transversely equally and oppositely above each end to engage said station track, said track having outboard rails and an inboard rail added a wheel base span behind the outboard rails on said slope up for inboard wheel at rear to engage on slope up and an inboard rail added a wheel span ahead of outboard rails on said slope down for said inboard wheel at front to engage on said slope down, the outboard wheels at opposite ends engaging the track where substantially level.

* * * * *